US008463167B2

(12) United States Patent
Tanaka et al.

(10) Patent No.: US 8,463,167 B2
(45) Date of Patent: Jun. 11, 2013

(54) IMAGE HEATING APPARATUS AND IMAGE HEATING ROTATIONAL BODY TO BE MOUNTED ON THE IMAGE HEATING APPARATUS

(75) Inventors: Masashi Tanaka, Sunono (JP); Atsuyoshi Abe, Susono (JP); Daisuke Aoki, Numazu (JP); Kazuhisa Kemmochi, Suntou-gun (JP); Tsutomu Miki, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 698 days.

(21) Appl. No.: 12/266,433

(22) Filed: Nov. 6, 2008

(65) Prior Publication Data

US 2009/0123203 A1 May 14, 2009

(30) Foreign Application Priority Data

Nov. 9, 2007 (JP) ..... 2007-292191
Dec. 21, 2007 (JP) ..... 2007-330948

(51) Int. Cl.
*G03G 15/20* (2006.01)
*G03G 21/00* (2006.01)

(52) U.S. Cl.
USPC ..... 399/327; 399/347

(58) Field of Classification Search
USPC ..... 399/328, 320, 327, 330, 333, 347
See application file for complete search history.

(56) References Cited

U.S. PATENT DOCUMENTS

| | | | | |
|---|---|---|---|---|
| 4,842,944 | A * | 6/1989 | Kuge et al. | 428/451 |
| 6,763,205 | B2 | 7/2004 | Izawa | |
| 7,224,922 | B2 | 5/2007 | Kemmochi | |
| 7,283,767 | B1 * | 10/2007 | Hagimoto et al. | 399/149 |
| 2007/0140757 | A1 * | 6/2007 | Poxon et al. | 399/327 |

FOREIGN PATENT DOCUMENTS

| | | |
|---|---|---|
| JP | 2-266383 | 10/1990 |
| JP | 7-89257 | 4/1995 |
| JP | 2000-194216 A | 7/2000 |
| JP | 2003-186327 | 7/2003 |
| JP | 2004-078251 A | 3/2004 |
| JP | 2005-266785 | 9/2005 |
| JP | 2006-011111 A | 1/2006 |
| JP | 2007-199282 A | 8/2007 |

* cited by examiner

*Primary Examiner* — Walter L Lindsay, Jr.
*Assistant Examiner* — Rodney Bonnette
(74) *Attorney, Agent, or Firm* — Canon USA Inc IP Division

(57) ABSTRACT

According to embodiments, a heating member or a sliding member arranged in contact with the surface of a fusing roller is moved in an intersecting direction with the rotational direction of the fusing roller in a contact state with the heating member or the sliding member so as to prevent a scratch from being generated on the surface of the fusing roller or to repair the scratch.

23 Claims, 29 Drawing Sheets

IMAGE HEATING APPARATUS AND IMAGE HEATING ROTATIONAL BODY TO BE MOUNTED ON THE IMAGE HEATING APPARATUS

BACKGROUND OF THE INVENTION

1. Field of the Invention

The present invention relates to an image heating apparatus suitably used as a fusing unit mounted on an image forming apparatus, such as an electrophotographic copying machine and a laser beam printer, and an image heating rotational body mounted on the image heating apparatus.

2. Description of the Related Art

As a fusing unit to be mounted on an electrophotographic image forming apparatus, a system is proposed (Japanese Patent Laid-Open No. 2003-186327) in that a heating member is arranged on the surface (outer circumferential surface) of a fusing roller and the fusing roller is heated from the outer circumferential surface side (referred to an externally heating system below). By heating only the outer circumferential surface of the fusing roller, a start-up period to a desired temperature as well as electric power consumption can be reduced. This externally heating type fusing unit is broadly classified into a contact type in that the heating member is arranged in contact with the surface of the fusing roller and a non-contact type in that the surface of the fusing roller is heated using a halogen heater as a heat source. The contact-type externally heating fusing unit has a merit of the high heat transfer efficiency in comparison with the non-contact type, because heat is transferred by directly bringing the heat source, such as a ceramic heater, into contact with the fusing roller.

However, in the contact-type externally heating fusing unit, the heating member is arranged in contact with the surface of the fusing roller, so that scratches may be generated on the surface of the fusing roller. If dust is pinched between the heating member and the fusing roller, the pinched foreign material slidably rubs the same position of the surface of the fusing roller, so that a scratch may be generated on the surface of the fusing roller along the rotational direction. During fusing toner images on a recording member, the surface configuration of the fusing roller is transferred onto the toner images on the recording member, image failure, such as a vertical streak, due to the scratch generated on the surface of the fusing roller may emerge on the fixed toner images.

The scratch on the surface of the fusing roller may be generated on not only the contact-type externally heating fusing unit but also on the fusing unit having the heat source inside the fusing roller. For example, when a number of the same-sized recording members are processed, a scratch may be generated in the boundary between a paper passage part and a non-paper passage part of the fusing roller. Such a scratch may also cause the image failure.

In the fusing roller having a releasing layer, such as a fluoreresin, as a surface layer, the surface of a new roller is a mirror plane and its surface roughness Rz is usually about 0.1 to 0.3 μm. Whereas, in the passage part of the recording member on the surface of the fusing roller, the surface is gradually devastated due to the damage from paper fibers and external additives, so that the scratch is gradually enlarged to the extent of a surface roughness Rz of 1.0 μm.

Since an edge part of paper is provided with burrs generated when cutting the paper, the edge part has a large effect on the fusing roller, so that the scratch is gradually enlarged to the extent of a surface roughness Rz of 1.0 to 2.0 μm. The paper burr is liable to be generated when the knife blade becomes blunt due to abrasion in the cutting process from large-sized paper.

In the non-paper passage part on the surface of the fusing roller, the recording member does not pass through; the surface layer of the fusing roller abuts a pressure member, which forms the nip together with the fusing roller; and the scratch is enlarged to the extent of a surface roughness Rz of 1.0 μm slowly compared with in the paper passage part.

As a result, the surface roughness of the fusing roller after continuous paper processing increases in the order of (3) the paper edge passage part>(1) the paper passage part>(2) the non-paper passage part>the initial state (new roller). Hence, as the use proceeds, the surface state of the fusing roller differs dependently on the position in the generating line direction.

Then, the surface state of the fusing roller and the glossiness unevenness on images will be described.

When fusing unfixed toner images, the fusing unit applies pressure and heat to the toner. At this time, the surface micro-configuration of the fusing roller is transferred onto the surface of fixed toner images. If the surface state of the fusing roller differs, the surface state of the toner images is differentiated along with this, resulting in glossiness unevenness. This phenomenon is significant in coated paper excellent in surface smoothness while being in an invisible level for office-use normal paper. According to the study by the inventor, the scratch generation due to paper edges depends on the paper kind; the scratch generation level is deteriorated for paper having burrs generated when cutting and the level is similar to this example for other thick paper and coated paper.

In general, the high glossiness is recognized when the reproducibility of specular reflected light images is high while the low glossiness is recognized when the reproducibility is low or none. For example, when viewing silver-film photographic images under fluorescent lightning, not only the fluorescent light is reflected, but also the shape of the fluorescent lamp is transferred, so that the high glossiness is recognized independently of consciousness. This indicates that the photographic images are in a mirror plane state with small unevenness.

On the other hand, in the case of low glossiness, the surface state of images is reversely uneven, so that the fluorescent light is diffusely reflected and the shape of the fluorescent lamp is not transferred. In such a manner, the unevenness on the image surface relates to the glossiness.

Since there are various sizes of the recording member, many scratches due to the passage of paper edges exist on the surface of the fusing roller along the generating line direction. Hence, when fusing images on high glossy coated paper requiring high image quality, streaks causing low glossiness may be transferred or the glossiness difference due to the partial difference in surface roughness on the fusing roller may be generated.

There are methods for rendering scratches invisible on fixed images by overlapping invisible fine scratches over the scratches generated on the surface of the fusing roller and by finely skiving the surface layer of the fusing roller to expose new layer. However, granted that it is finely, the blemishing the surface reduces the surface nature, so that the reduced glossiness becomes a problem. Furthermore, when using a sliding member for overlapping invisible fine scratches or for finely skiving the surface layer, dust and foreign materials may be pinched, so that a secondary problem of vertical streaks generated in the circumferential direction has arisen.

SUMMARY OF THE INVENTION

The present invention is directed to an image heating apparatus having excellent image quality after the image is heated.

The present invention also provides an image heating apparatus capable of preventing scratches from being generated on the surface of a rotational body.

The present invention also provides an image heating apparatus having a capability of repairing scratches even if the scratches are generated on the surface of a rotational body.

The present invention also provides an image heating apparatus capable of promptly repairing scratches on the surface of a rotational body and an image heating rotational body used in the image heating apparatus.

According to an aspect of the present invention, an image heating apparatus includes: a rotational body arranged in contact with a recording member carrying an image thereon; a heating member arranged in contact with the surface of the rotational body and configured to heat the rotational body; and a backup member forming a nip, in cooperation with the rotational body, that pinches and conveys the recording member carrying the image thereon. At least one of the rotational body and the heating member can be moved in an intersecting direction with a rotational direction of the rotational body in a state that the rotational body and the heating member are arranged in contact with each other.

According to another aspect of the present invention, an image heating apparatus includes: a rotational body arranged in contact with a recording member carrying an image thereon; a heating member arranged in contact with the surface of the rotational body and configured to heat the rotational body; and a backup member forming a nip, in cooperation with the rotational body, that pinches and conveys the recording member carrying the image thereon. The apparatus has a function to partially extend the surface of the rotational body in an intersecting direction with a rotational direction of the rotational body so as to transform the surface to be scaly.

According to yet another aspect of the present invention, an image heating apparatus includes: a rotational body including a releasing layer on its surface; a heating unit configured to heat the rotational body; a backup member forming a nip, in cooperation with the rotational body, that pinches and conveys a recording member carrying an image thereon; and a sliding member arranged in contact with the surface of the rotational body to extend the releasing layer in an intersecting direction with a rotational direction of the rotational body for transforming the releasing layer to be scaly.

According to yet another aspect of the present invention, an image heating rotational body includes: a base layer; and a releasing layer arranged in contact with images, wherein the releasing layer includes a scaly face extended in an intersecting direction with a rotational direction of the rotational body.

Further aspects of the present invention will become apparent from the following detailed description with reference to the accompanying drawings.

DESCRIPTION OF THE EMBODIMENTS

First Embodiment

A first embodiment of the present invention will be described below. First, an image forming apparatus having an image heating apparatus according to the embodiment mounted thereon as a fusing unit will be described and then, an image heating apparatus according to embodiments will be described in detail.

[Configuration of Image Forming Apparatus Body]

Figure 23:
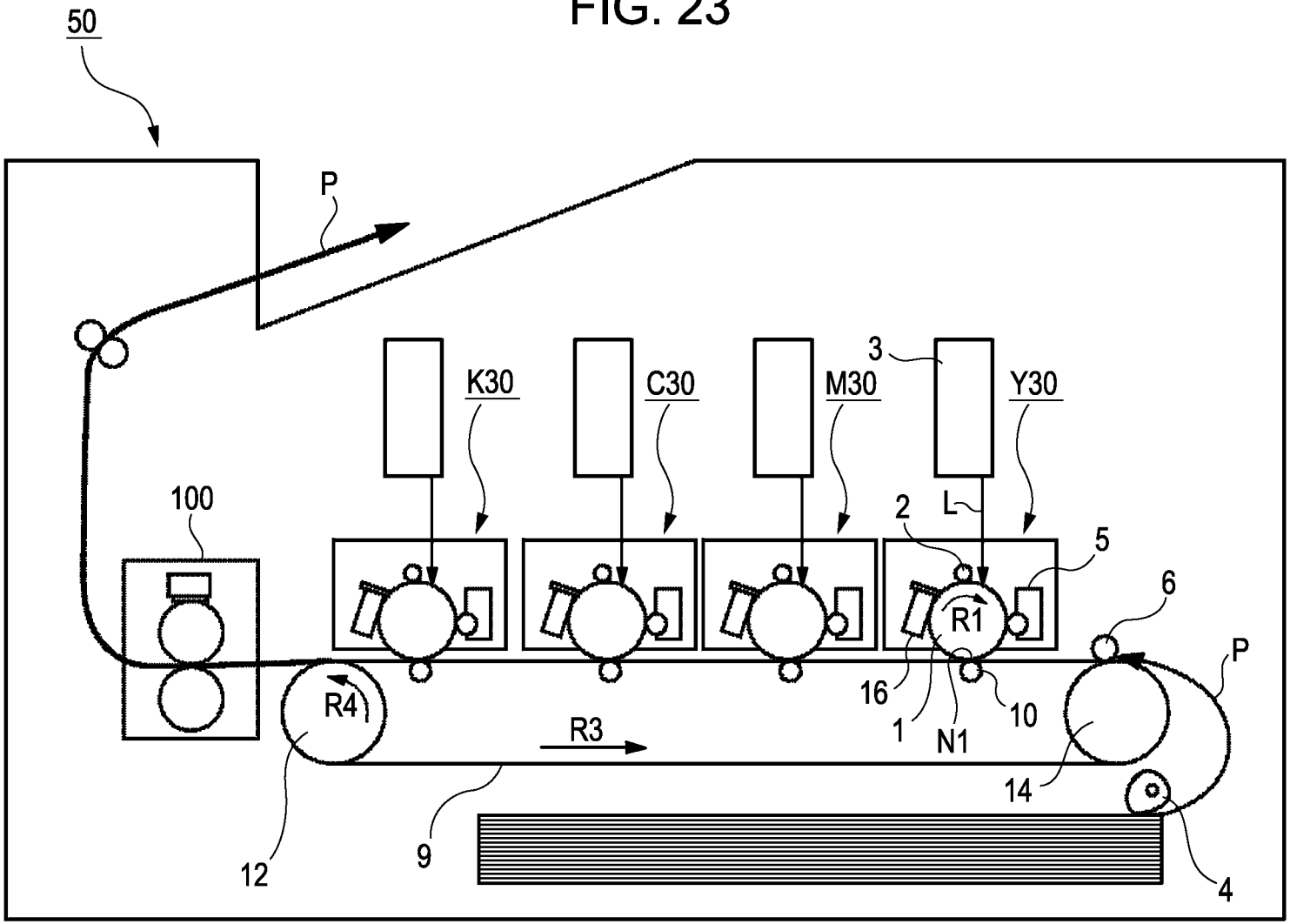
FIG. 23 is a sectional view of an image forming apparatus having an image heating apparatus according to embodiments mounted as a fusing unit.

A common method for forming unfixed toner images on a recording member as a member to be heated will be described with reference to a schematic drawing of FIG. 23.

An image forming apparatus 50 according to the embodiment is a full-color printer in that an image is formed by sequentially transferring four-color toner images of yellow, magenta, cyan, and black on one recording member P conveyed on a recording member conveying belt 9. Around a photosensitive drum 1, a charger 2, an exposure unit 3 for irradiating the photosensitive drum 1 with a laser beam corresponding to image information, and a developing unit 5 for developing electrostatic latent images formed on the photosensitive drum 1 by applying toner thereon that are arranged along a rotational direction (arrow R1 direction) sequentially in that order. On one side of the recording member conveying belt 9 opposite to the side where the photosensitive drum 1 is arranged, a transfer roller 10 is arranged to have a voltage applied for transferring toner images to the recording member P. Reference numeral 16 denotes a photosensitive drum cleaner.

To start image forming, the surface of the photosensitive drum 1 is charged in negative polarity by the charger 2. The negatively charged photosensitive drum 1 is scanned with a laser beam L emitted from the exposure unit 3 to form electrostatic latent images thereon (the exposed surface potential is increased). Then, toner is applied to the electrostatic latent image portion on the photosensitive drum 1 with the developing unit 5 containing yellow toner as a first color so as to form toner images on the photosensitive drum 1.

On the other hand, the recording member conveying belt 9 is journaled on two shafts (a driving roller 12 and a tension roller 14) and is rotated in arrow R3 direction by the driving roller 12 rotating in arrow R4 direction in the drawing. The recording member P fed by a feed roller 4 is charged by an attracting roller 6 biased in positive polarity so as to be electrostatically attracted on the recording member conveying belt 9 and conveyed. When the recording member P is introduced into a transfer nip N1, the transfer roller 10 rotating to follow the recording member conveying belt 9 is transfer-biased with positive polarity by a power supply (not shown), so that yellow toner images on the photosensitive drum 1 is transferred on the recording member P at the transfer nip N1. After the transfer, the photosensitive drum 1 is cleaned with a photosensitive drum cleaner 16 having a resilient blade.

A series of image forming processes of charging, exposing, developing, transferring, and cleaning described above is also performed sequentially on developing cartridges Y30 for first color yellow, M30 for second color magenta, C30 for third color cyan, and K30 for fourth color black, so that four-color toner images are overlapped on the recording member P on the recording member conveying belt 9. The recording member P carrying the four-color toner images thereon is conveyed to a fusing unit 100 such that the toner images on the recording member P are heated and fixed on the recording member P and then, discharged outside the printer.

[Fusing Unit (Image Heating Apparatus)]

Then, the fusing unit 100 that characterizes the present invention will be described below. The fusing unit 100 according to the embodiment is a contact-type external heating fusing unit for reducing a start-up period and electric power consumption as mentioned above. In the contact-type external heating fusing unit, as described above, when foreign materials, such as dust, intervene in the contact portion between a heating member and a fusing roller, the foreign material slidably rubs the same position on the surface of the fusing roller by the rotation of the fusing roller, so that the surface of the fusing roller may have a scratch along the rotational direction of the fusing roller. According to the embodiment, by relatively sliding the fusing roller and the heating member in a direction different from the rotational direction of the fusing roller (an intersecting direction), the scratch on the fusing roller in the rotational direction can be suppressed, which will be described below in detail.

Figure 1:
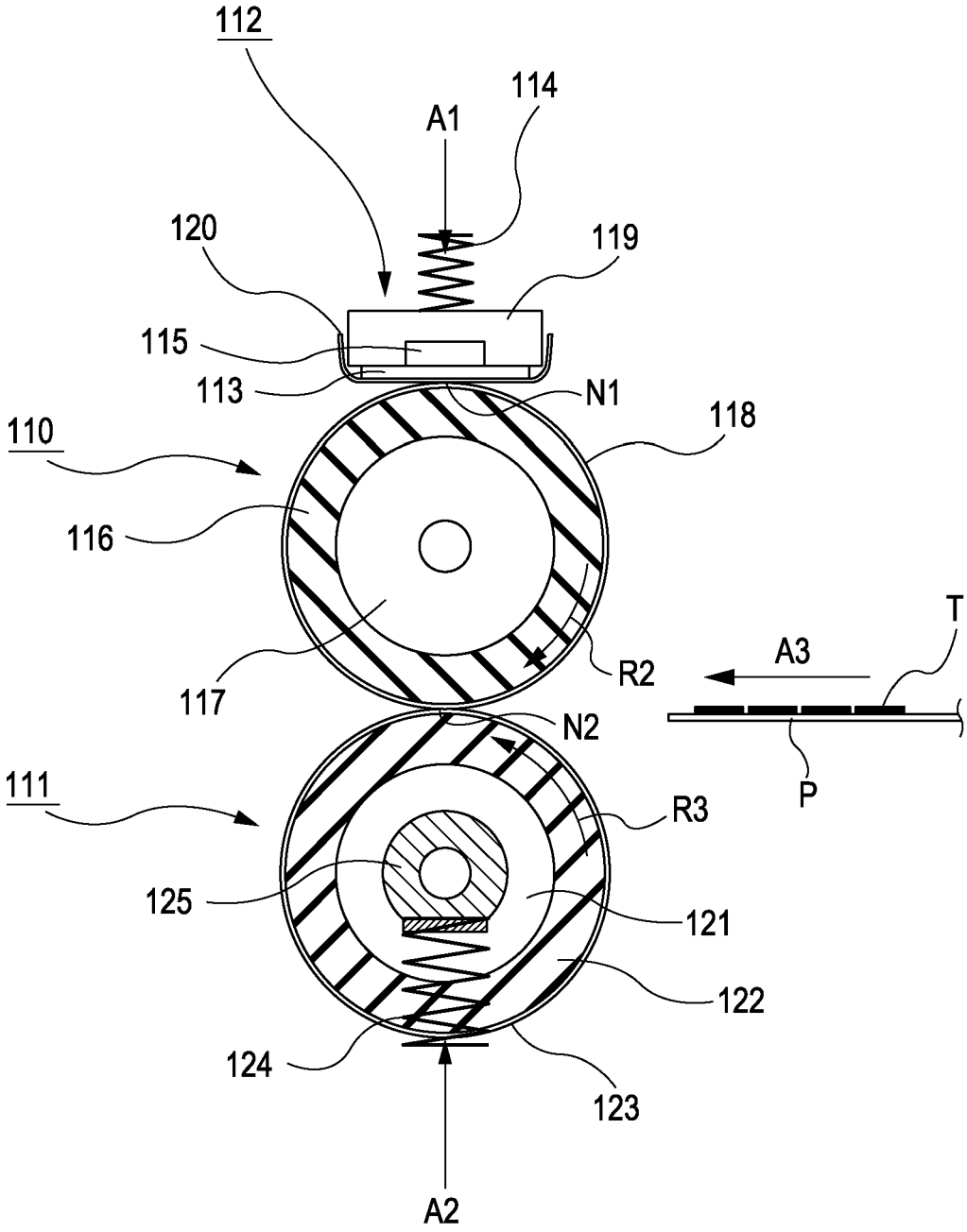
FIG. 1 is a sectional view of an image heating apparatus according to a first embodiment.

FIG. 1 is a schematic sectional view of the fusing unit according to the embodiment. A heating member 112 for heating a fusing roller 110 is arranged in contact with the surface (the external circumferential surface) of the fusing roller (rotational body) 110 to form a contact heating head N1. A pressure roller (a backup member) 111 is also arranged in contact with the fusing roller 110 to form a fusing nip N2. The recording member P carrying toner images T thereon is pinched and conveyed in the fusing nip N2 so as to be fused by heating.

The diameter of the fusing roller 110 is 20 mm, and on the outside of an iron core metal (a base layer) 117 with a diameter of 12 mm, an expanded silicone rubber elastic layer 116 (a form rubber layer) is formed with a thickness of 4 mm. In the fusing roller 110, if its heat capacity and thermal conductivity are large, the heat applied on its circumferential surface is liable to be absorbed inside the fusing roller 110, so that the surface temperature is difficult to be increased. Namely, the start-up period of the surface temperature of the fusing roller 110 can be reduced when the heat capacity and the thermal conductivity of the elastic layer 116 are reduced as small as possible with higher insulation effectiveness. The thermal conductivity of the above-mentioned expanded silicone form rubber is 0.11 to 0.16 W/(m·K), which is smaller than solid rubber with about 0.25 to 0.29 W/(m·K) in thermal conductivity. The specific weight having relations with the heat capacity is about 1.05 to 1.30 for the solid rubber while being about 0.75 to 0.85 for the form rubber with lower heat capacity. Thus, the use of the form rubber may reduce the start-up period of the surface temperature of the fusing roller 110.

When the diameter of the fusing roller 110 is rather smaller, its heat capacity may be reduced smaller; however, if it is excessively small, the width of the contact heating head N1 in the rotational direction of the fusing roller 110 becomes smaller, so that an appropriate diameter is required. In view of this fact, the diameter of the fusing roller 110 according to the embodiment is 20 mm. As for the wall thickness of the elastic layer 116, if it is excessively thin, the heat is liable to diffuse to the iron core metal 117, so that an appropriate wall thickness is required. In view of this fact, the thickness of the elastic layer 116 according to the embodiment is 4 mm.

On the elastic layer 116, a releasing layer 118 made of a perfluoroalkoxy resin (PFA) is formed. The releasing layer 118 may be any of a tube covering the elastic layer 116 and lacquer with which the elastic layer 116 is coated; whereas, according to the embodiment, a tube having excellent durability is used. The material of the releasing layer 118, in addition to PFA, may include a fluororesin, such as a polytetrafluoroethylene resin (PTFE) and a tetrafluoroethylene/hexafluoropropylene resin (PFA), and fluorine rubber or silicone rubber, being excellent in releasing property.

If the surface hardness of the fusing roller 110 is low, the width of the contact heating head N1 is large even under low pressure; however, if it is excessively low, the durability is deteriorated, so that the surface hardness of the fusing roller 110 according to the embodiment is set to have an Asker-C hardness (load: 4.9N) of 40 to 45°. The fusing roller 110 is to be rotated by the power of a power source (not shown) at a surface migration speed of 60 mm/sec in arrow R2 direction in the drawing.

It is desirable that the pressure roller 111 have low heat capacity and low thermal conductivity for preventing to absorb heat from the fusing roller 110. The pressure roller 111 according to the embodiment satisfies the same specifications as those of the fusing roller 110: the diameter of the pressure roller 111 is 20 mm; on the outside of an iron core metal 121 with a diameter of 12 mm, an expanded rubber elastic layer 122 is formed with a thickness of 4 mm; and a releasing layer 123 made of PFA is provided as an outermost layer. The pressure roller 111 is pressurized in arrow A2 direction in the drawing by pressure roller pressure springs 124 via bearings 125 under a load of 147N. Thereby, the fusing nip N2 is formed with a width of 7 mm between the pressure roller 111 and the fusing roller 110. The pressure roller 111 is rotated to follow the fusing roller 110 in arrow R3 direction.

The heating member 112 arranged in contact with the releasing layer 118 of the fusing roller 110 includes a heater 113 as a heat source, a heater holder 119 made of a heat-resistant resin for holding the heater 113, and a sliding layer 120 provided on the surface of the heater 113 arranged in contact with the fusing roller 110.

The heating member 112 is pressurized in arrow A1 direction in the drawing by pressure roller pressure springs 114 under a load of 98N. Thereby, the contact heating head N1 is formed with a width of 5.5 mm in the rotational direction of the fusing roller. The heater 113 includes a ceramic substrate (made of alumina according to the embodiment) with a thickness of 1 mm and a width of 6 mm in the rotational direction of the fusing roller, a heating-resistant layer made of Ag/Pd (silver/palladium) with a thickness of 10 μm screen-printed on the ceramic substrate, and a glass layer with a thickness of 50 μm covering the heating-resistant layer for protection.

The surface of the fusing roller 110 may be heated by directly bringing the glass surface of the heater 113 into contact with the surface of the fusing roller 110; whereas, according to the embodiment, the sliding layer 120 excellent in releasing property and sliding performance is provided on the surface of the heater 113. The sliding layer 120 restrains toner shifted to over the surface of the fusing roller 110 from adhering to the heating member 112 while reducing the frictional force due to the sliding over the fusing roller 110. The material of the sliding layer 120 may suitably include a fluororesin, such as PFA excellent in releasing property from toner and PTFE excellent in sliding property. Since if the thickness of the sliding layer 120 is excessively large, the heat of the heater 113 is difficult to transfer to the fusing roller 110; if excessively small, the durability falls short, so that a thickness of 1 to 100 μm is preferred. For reducing the contact thermal resistance to the heater 113, the glass layer of the heater 113 may be directly coated with the sliding layer 120; alternatively, a sheet member excellent in durability and surface nature may be provided between the heater 113 and the fusing roller 110. When using the sheet member, it can be arranged to cover the edges of the heater 113 on the upstream and the downstream sides in the rotational direction of the fusing roller, so that it is advantageous to protect the fusing roller 110 against the edges of the heater 113. According to the embodiment, a PFA sheet with a thickness of 50 μm is used for the sliding layer 120 that is arranged to cover the edges of the heater 113.

On the rear face of the heater 113, a temperature detection element 115 is arranged for detecting the temperature of the back of the ceramic substrate, which increases in temperature due to the heating of a heating resistance layer. The temperature of the heater 113 is regulated by controlling the electric power supplying to the heating resistance layer from an electrode unit (not shown) arranged at an end of the ceramic substrate in the longitudinal direction of the ceramic substrate (in a direction perpendicular to the rotational direction of the fusing roller), in accordance with the signal from the temperature detection element 115. According to the embodiment, the electrification to the heating resistance layer is controlled such that the temperature detected by the temperature detection element 115 maintains a target temperature. Then, the heat generated by the heater 113 is transferred to the surface of the fusing roller 110 via the contact heating head N1. The target temperature during fusing is 180° C.

The heat source of the fusing unit according to the embodiment is only the heating member 112 arranged in contact with the releasing layer 118 of the fusing roller 110 and it does not exist inside the fusing roller 110. It is also preferable that the material of the heater holder 119 be higher in insulation effectiveness for efficiently transferring the heat generated by the heater 113 to the fusing roller 110.

When the recording member P having unfixed toner images T transferred thereon is conveyed to the fusing nip N2 by a transportation unit (not shown), the heat of the surface of the fusing roller 110 is transferred to the unfixed toner images T and the recording member P such that the toner images T are to be fused on the surface of the recording member P by heating.

Then, there will be described a configuration in that the heating member 112 and the fusing roller 110 are relatively slid in a direction intersecting with the rotational direction of the fusing roller, that is, a configuration (moving mechanism) in that at least one of a rotational body and a heating member is movable in a direction intersecting with the rotational direction of the rotational body in a state that the rotational body and the heating member are arranged in contact with each other.

Figure 2:
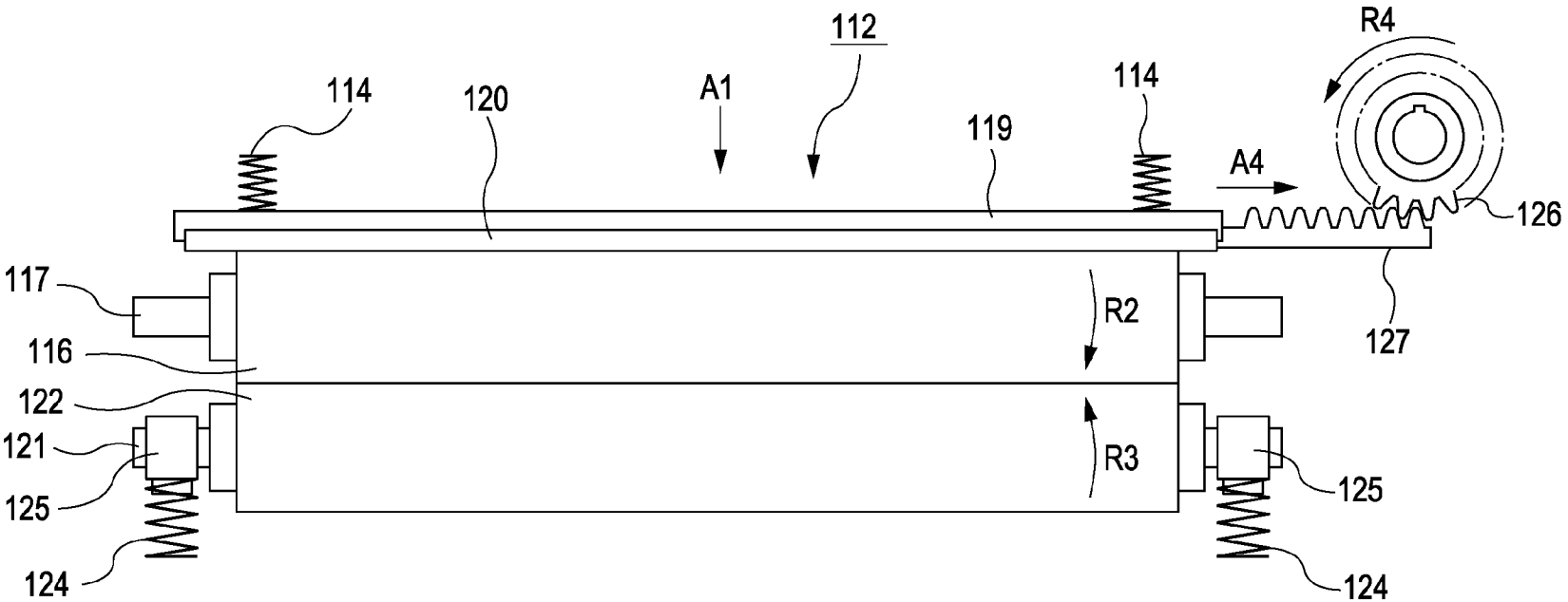
FIG. 2 is a front view of the image heating apparatus according to the first embodiment.

FIG. 2 is a front view of the fusing unit viewed in arrow A3 direction in FIG. 1. At an end of the heating member 112 in the longitudinal direction, a rack 127 is provided, and by rotating a (pinion) gear 126 in arrow R4 direction by a driving unit (not shown), the heating member 112 is to be slid in arrow A4 direction (the axial direction of the fusing roller). The sliding of the heating member 112 in arrow A4 direction may be always executed regardless of the rotation/non-rotation of the fusing roller 110; however, if it is executed during stoppage of the fusing roller 110, the surface of the fusing roller 110 may have a scratch along a direction parallel with the axial direction. According to the embodiment, the heating member 112 is to be slid only when the fusing roller 110 is rotating. The fusing unit according to the embodiment includes no mechanism for moving the fusing roller 110 in the axial direction (the longitudinal direction). Hence, when the heating member 112 is slid in the axial direction (the longitudinal direction), the fusing roller 110 is fixed without moving in the axial direction.

Figure 3:
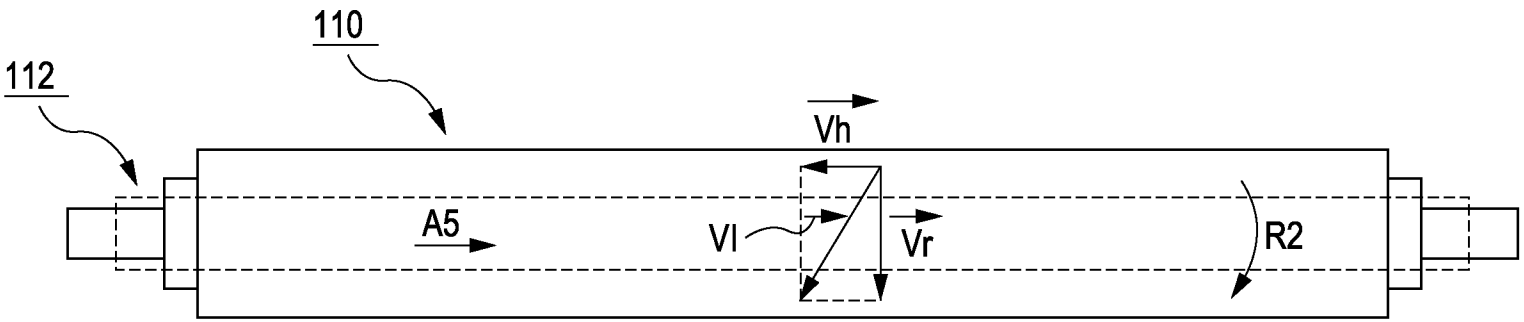
FIG. 3 is a plan view of the image heating apparatus according to the first embodiment.

FIG. 3 is a drawing of the fusing unit viewed in arrow A1 direction in FIG. 2. When the fusing roller 110 rotates in arrow R2 direction, the heating member 112 shown with dotted lines is slid in arrow A5 direction. Therefore, when viewing the surface of the fusing roller 110 from a fixed point adjacent to the heating member 112, the surface of the fusing roller 110 moves in a vector sum direction V1 (=Vr+Vh) of the rotational movement of the fusing roller 110 in the R2 direction (a vector Vr) and the sliding movement of the heating member 112 in the A5 direction (a vector Vh).

Since the surface of the fusing roller 110 constantly moves relative to the heating member 112 in an oblique direction V1 intersecting with the rotational direction R2 of the fusing roller 110, even a foreign material, such as dust, is caught into the contact heating head N1, the material cannot slidably rub the same position on the surface of the fusing roller 110. Hence, scratches on the surface of the fusing roller 110 can be restrained from enlarging in depth and width to such an extent that the scratch becomes a vertical streak on images.

If the fusing roller and the heating member do not slide relatively to each other in a direction intersecting with the rotational direction of the fusing roller, and when a foreign material is pinched between the fusing roller and the heating member, the surface of the fusing roller may have a deep scratch. The scratch of the fusing roller is transferred onto toner images on the recording member during fusing. In low print coverage rate images (the print coverage rate is defined as a percentage of an area of an image in black printed on a sheet relative to a printable area of the sheet), such as a document and half tone images, the scratch of the fusing roller is difficult to appear as a vertical streak on the toner images; whereas, in high print coverage rate images, such as solid images and a photograph, the scratch of the fusing roller is liable to appear as the vertical streak on the toner images. The vertical streak on the toner images may be conspicuous especially when the images are formed on glossy paper requiring glossiness, because for increasing the image glossiness, it is necessary that toner is sufficiently fused so as to sufficiently transfer the surface configuration of the fusing roller onto the surface of the toner images.

With increasing depth of the scratch on the fusing roller, the scratch is liable to be conspicuous as the streak, so that when the surface roughness (10-point roughness average Rz) is 3 μm or more, the scratch emerges as a streak in the case where high print coverage rate images are fused on glossy paper requiring glossiness. Furthermore, if the surface roughness (10-point roughness average Rz) is 6 μm or more, the streak becomes conspicuous on the glossy paper, even on normal paper not requiring glossiness, the streak may emerge dependently on the print coverage rate. Hence, it is necessary that the surface roughness of the fusing roller is to be 3 μm or less in terms of 10-point roughness average Rz. The scratch with a depth of 3 μm or less in terms of 10-point roughness average Rz may not be recognized as the streak by human eyes even high print coverage rate images are fused on glossy paper requiring glossiness.

In the configuration according to the embodiment in that the heating member and the fusing roller are relatively slid in a direction intersecting with the rotational direction of the fusing roller and a comparative example configuration in that the heating member 112 and the fusing roller 110 are not relatively slid in a direction intersecting with the rotational direction of the fusing roller, the print endurance was tested and compared the test results. In the print endurance test, images with 5% print coverage rate were continuously printed on a plurality of recording members; up to continuous 10,000 sheets, checked on the scratch of the fusing roller every 1,000 sheets; and after continuous 10,000 sheets, checked on the scratch every 10,000 sheets. The scratch of the fusing roller was confirmed by measuring the scratch depth with a surface roughness gauge and by checking on the presence of the streak on the solid images on normal paper and glossy paper.

Figure 4:
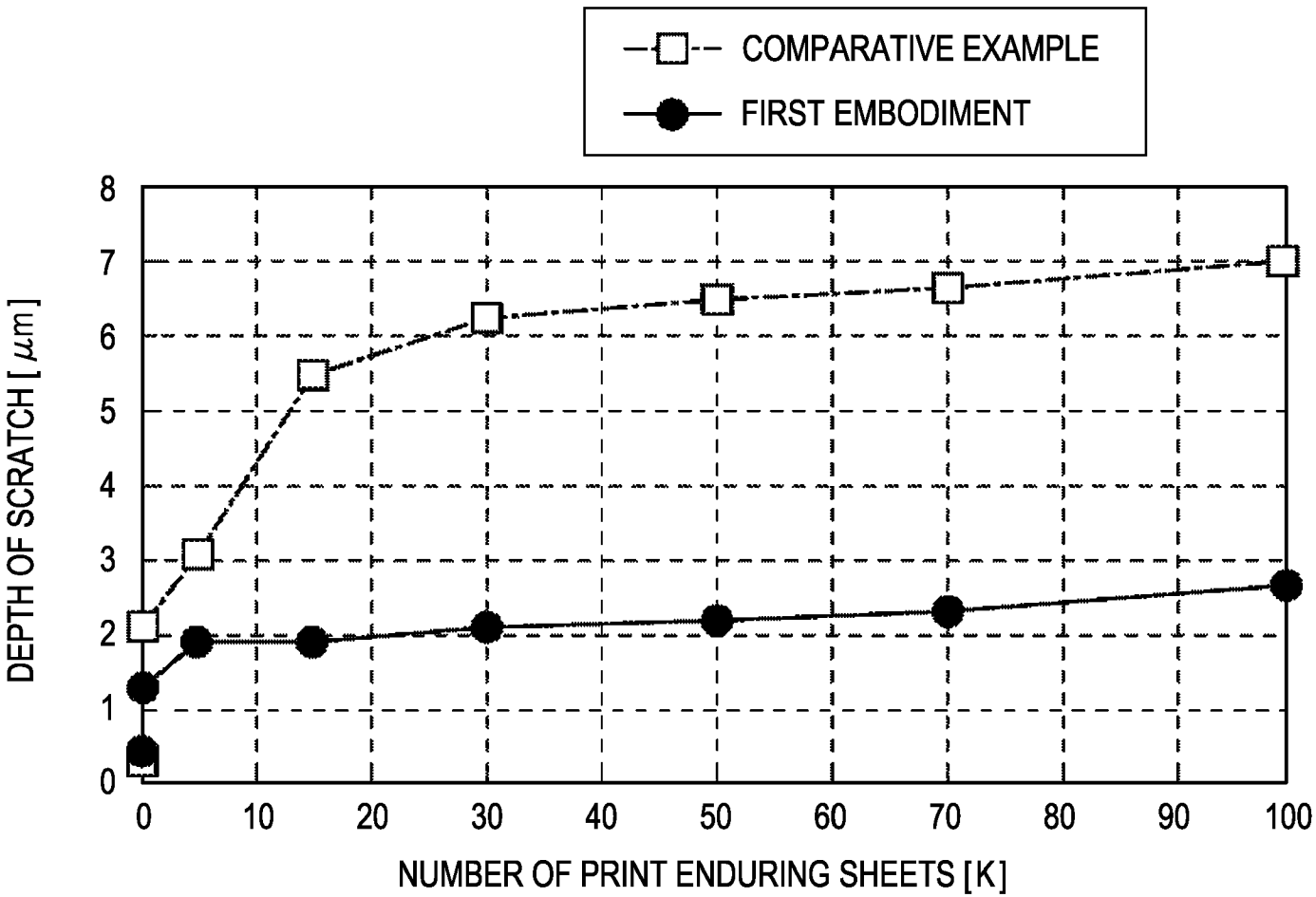
FIG. 4 is a drawing showing scratch generating results on the surface of a fusing roller from print endurance tests in the image heating apparatus according to the first embodiment and an image heating apparatus of a comparative example.

FIG. 4 shows the results of the scratch depth of the fusing roller from the print endurance test. Numeral 10 on a scale in abscissa denotes 10,000 sheets. In the comparative example configuration, at first 4,000-sheet printing, the scratch depth (10-point roughness average Rz) of the fusing roller reaches 3 μm or more and the streak is generated on the solid images on the glossy paper. Furthermore, after 30,000 sheets, the scratch depth (10-point roughness average Rz) of the fusing roller becomes 6 μm or more and the streak is generated on the solid images even on the normal paper.

Whereas, in the configuration according to the embodiment, since during rotation of the fusing roller 110, the heating member 112 is slid in a direction perpendicular to the rotational direction of the fusing roller 110 in a state that both the members are arranged in contact with each other, the scratch depth (10-point roughness average Rz) of the fusing roller can be reduced below 3 μm up to 100,000-sheet printings, which are the life-time printings of the fusing unit according to the embodiment. Thus, when images are formed even on the glossy paper, on which the streak is liable to be conspicuous, image streak failure has not generated on the solid images until the end of the fusing unit life.

When a number of small-sized sheets are processed, scratches may be generated due to sheet edges in the rotational direction of the fusing roller 110; whereas, according to the embodiment, even when a number of small-sized sheets are processed, the streak due to edges of small-sized sheets can be restrained from emerging on images.

In the configuration described above, the whole heating member 112 is slid; alternatively, during fixing the heater 113 and the heater holder 119, the sliding layer 120 and the fusing roller 110 may also be relatively slid in a direction intersecting with the rotational direction of the fusing roller 110. For example, the heater 113 and the heater holder 119 are fixed, and only the sliding layer 120 may be slid in the axial direction.

Figure 5:
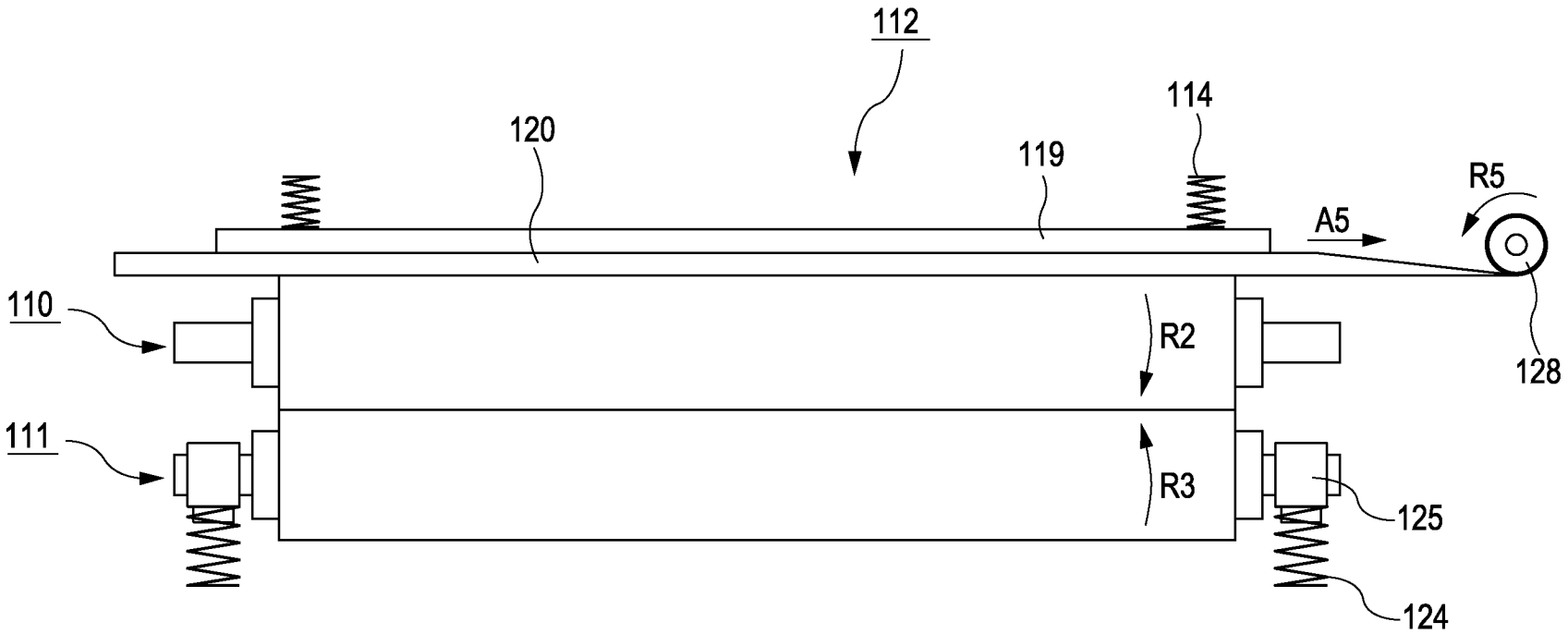
FIG. 5 is a front view of an image heating apparatus according to a modification from the first embodiment in that only a sliding layer, which is part of a heating member, is slid.

FIG. 5 shows a configuration as an example in that only the sliding layer 120 is slid. A take-up roller 128 is provided for winding the sheet-like sliding layer 120; during the rotation of the fusing roller 110 in the R2 direction, the take-up roller 128 is rotated in the R5 direction so as to wind the sliding layer 120. Also, in this configuration, the sliding layer 120 of the heating member 112 is slid in arrow A5 direction, so that the surface of the fusing roller 110 moves relative to the heating member 112 in an oblique direction intersecting with the rotational direction R2 in the same way in the configuration of FIG. 2. Thus, a scratch having such a depth that the scratch emerges as the streak on images can be restrained from being generated on the surface of the fusing roller 110.

In the configuration according to the embodiment, the fusing roller 110 is fixed and the heating member 112 is slid; however, the heating member 112 may be fixed and the fusing roller 110 may also be slid in a direction intersecting with the rotational direction of the fusing roller 110. Alternatively, both the heating member 112 and the fusing roller 110 may be slid relatively to each other in the intersecting direction.

The sliding direction of the heating member 112 and the fusing roller 110 is not limited to the axial direction, so that when the heating member 112 and the fusing roller 110 are slid in a direction intersecting with the rotational direction of the fusing roller 110, the surface of the fusing roller 110 moves relative to the heating member 112 in an oblique direction different from the rotational direction of the fusing roller 110, so that the same benefits can be obtained.

According to the embodiment, when the fusing roller rotates while the heating member heating the fusing roller (rotational body), at least one of the fusing roller and the heating member can be moved in a direction intersecting with the rotational direction of the fusing roller in a state that the fusing roller and the heating member are arranged in contact with each other, so that the functions can be obtained to partially extend the surface of the fusing roller in a direction intersecting with the rotational direction of the rotational body for making the surface scaly as well as to repair the scratch generated on the surface of the fusing roller. This will be described from the following second embodiment on.

Second Embodiment

A second embodiment of the present invention will be described below. Like reference numerals and symbols designate like components common to the first embodiment and the description is omitted.

According to the embodiment, at least one of the heating member 112 and the fusing roller 110 reciprocates in a direction intersecting with the rotational direction of the fusing roller 110 in a state that both the members are arranged in contact with each other.

Figure 6:
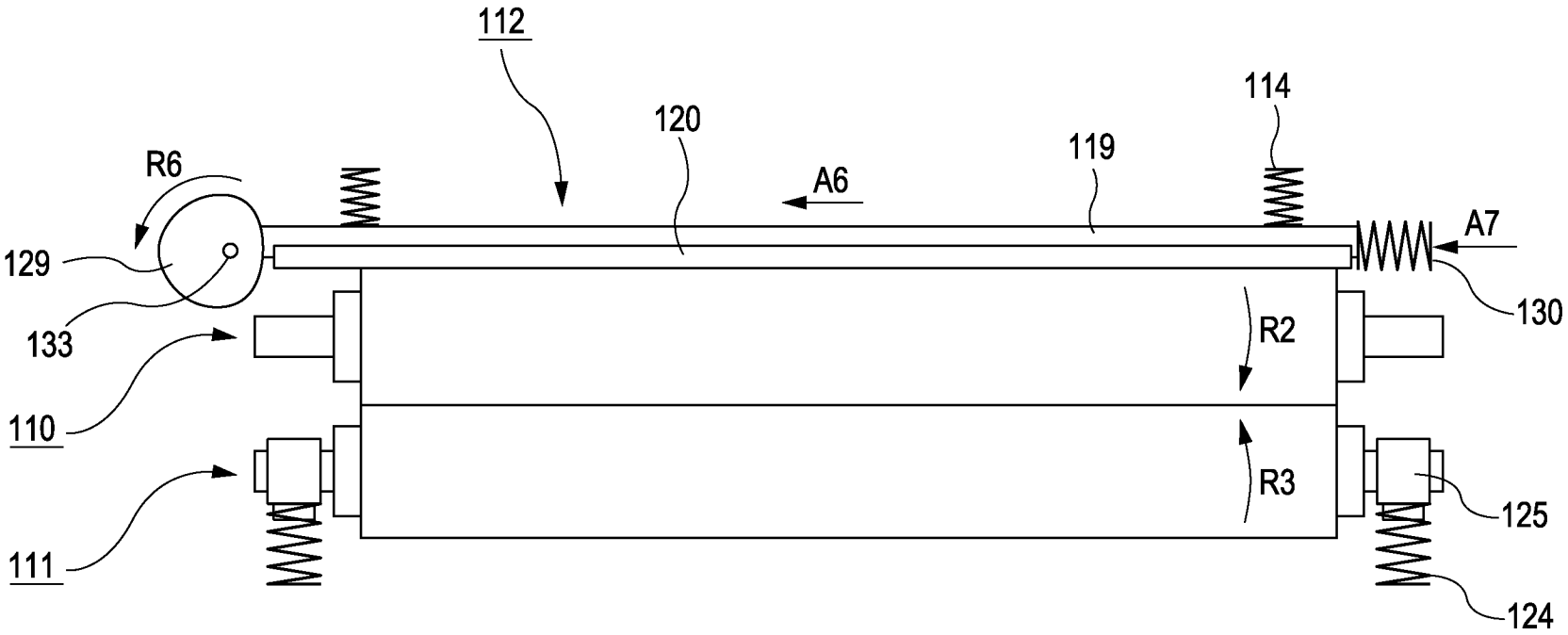
FIG. 6 is a front view of an image heating apparatus according to a second embodiment.

FIG. 6 is a front view of a contact-type externally heating fusing unit according to the embodiment. In the same way as in the first embodiment, the fusing roller 110 is fixed in the axial direction, and by the rotation of the fusing roller 110 in arrow R2 direction, the pressure roller 111 is rotated to follow the fusing roller 110 in arrow R3 direction.

The heating member 112 is slidable in a direction in parallel with the axis of the fusing roller 110, and is slid from one side in arrow A6 direction by a pressure spring 130 that pressurizes the heating member 112 in arrow A7 direction at a load of 49N. On the other hand, a cam 129 is provided on the side of the heating member 112 opposite to the pressure spring 130 for rotating about a cam shaft 133 in arrow R6 direction by a rotating unit (not shown).

Figure 7:
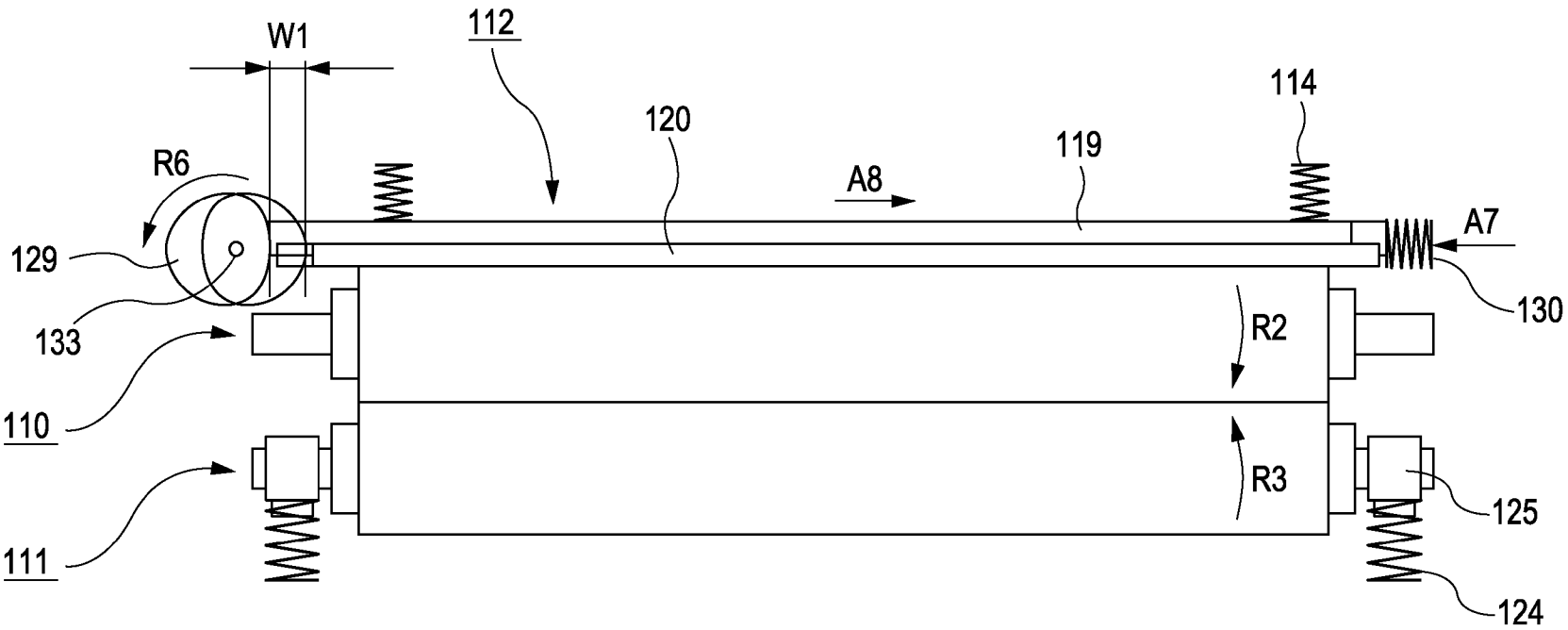
FIG. 7 is a front view showing a state of the image heating apparatus in that the heating member is slid to a position different from that of the image heating apparatus shown in FIG. 6.

FIG. 7 shows the cam 129 rotated by 180° from the phase shown in FIG. 6. When the cam 129 rotates by 180° from the phase shown in FIG. 6, the heating member 112 is slid in arrow A8 direction by the cam 129 pushing the heating member 112. When the cam 129 further rotates by 180° in arrow R6 direction, the heating member 112 returns to the position of FIG. 6, because it is pressed by the pressure spring 130 in arrow A7 direction. Namely, during the rotation of the cam 129 in arrow R6 direction, the heating member 112 reciprocates in the axial direction (a direction intersecting with the rotational direction of the fusing roller 110). During the rotation of the fusing roller 110, the cam 129 reciprocates the heating member 112 by rotating in arrow R6 direction. Hence, in the same way as in the first embodiment, the surface of the fusing roller 110 moves relative to the heating member 112 in an oblique direction different from the rotational direction R2 of the fusing roller 110 so as to have benefits for reducing the depth of the scratch generated on the surface of the fusing roller 110.

In the same way as in the first embodiment, benefits can also be obtained that repair the scratch generated on the surface of the fusing roller 110. If the sliding displacement W1 of the heating member 112 due to the cam 129 is about 1 mm, benefits can be obtained reducing the depth of the scratch on the surface of the fusing roller 110 or repairing the scratch. This effect is significant when the side displacement W1 is rather larger, and according to the embodiment, the side displacement W1 is set at 4 mm. If the reciprocating period of the heating member 112 is synchronized with the rotating period of the fusing roller 110, the heating member 112 slidably rubs the same position on the surface of the fusing roller 110 at the contact heating head N1, so that it is desirable that the reciprocating period of the heating member 112 be not synchronized with that of the fusing roller 110. According to the embodiment, the period of the fusing roller 110 is about 1.05 sec while the sliding time per reciprocation is set at 6 sec.

In the configuration according to the embodiment, the heating member 112 is slid in the axial direction by its reciprocating, so that the heating member 112 can be slid semi-permanently and independently of the longitudinal length of the member to be moved in the longitudinal direction.

On the configuration described above, the print endurance was tested in the same way as in the first embodiment. The surface of the fusing roller 110 moves relative to the heating member 112 in an oblique direction different from the rotational direction of the fusing roller 110 in the same way as in the configuration according to the first embodiment. Hence, the depth (10-point roughness average Rz) of the scratch on the surface of the fusing roller 110 can be reduced below 3 μm, so that the image failure, such as a streak, can be suppressed until the end of the fusing unit life independently of the kind of paper and the print coverage rate, in the same way as in the first embodiment.

Figure 8:
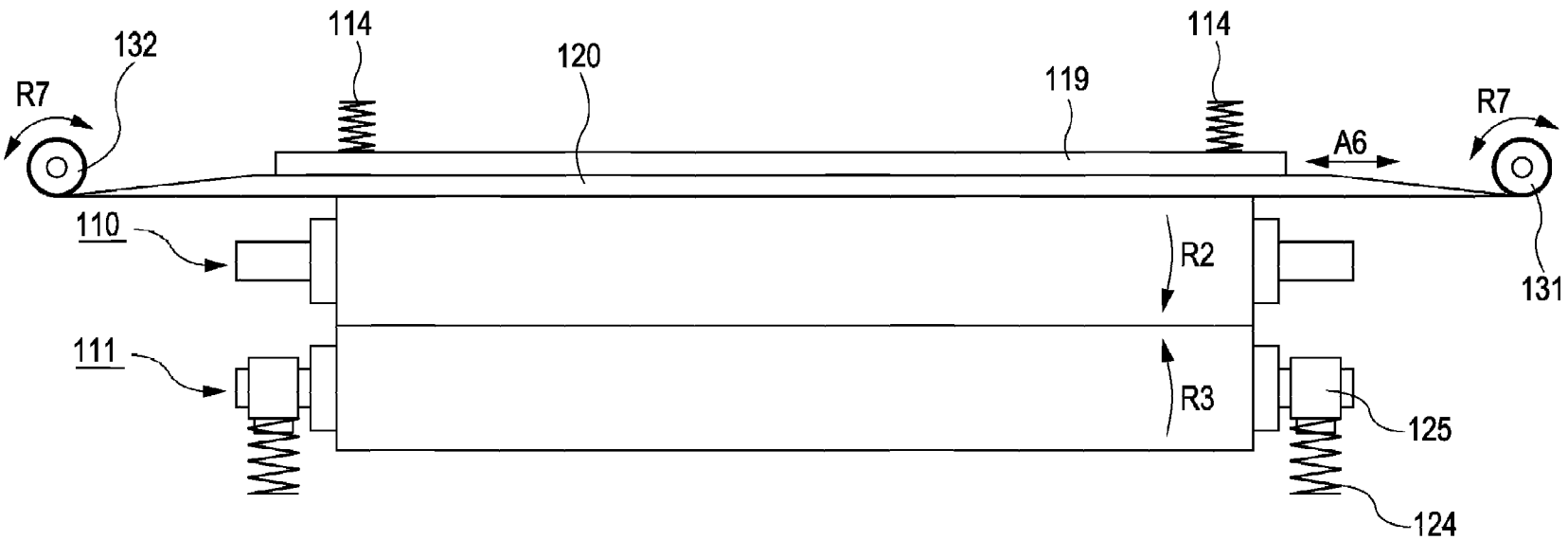
FIG. 8 is a front view of an image heating apparatus according to a modification from the second embodiment in that only the sliding layer, which is part of the heating member, is slid.

According to the embodiment, the whole heating member 112 is reciprocated; alternatively, the sliding layer 120, which is part of the heating member, may also be reciprocated. For example, FIG. 8 shows a configuration in that only the sliding layer 120 is reciprocated. Take-up rollers 131 and 132 are provided at both ends of the heating member 112 for reciprocating the sheet-like sliding layer 120. During the rotation of the fusing roller 110 in the R2 direction, the take-up rollers 131 and 132 to-and-fro rotate in arrow R7 direction so as to reciprocate the sliding layer 120. In this configuration, the surface of the fusing roller 110 also moves relative to the heating member 112 in an oblique direction different from the rotational direction of the fusing roller 110, so that the same benefits as described above can be obtained.

Figure 9:
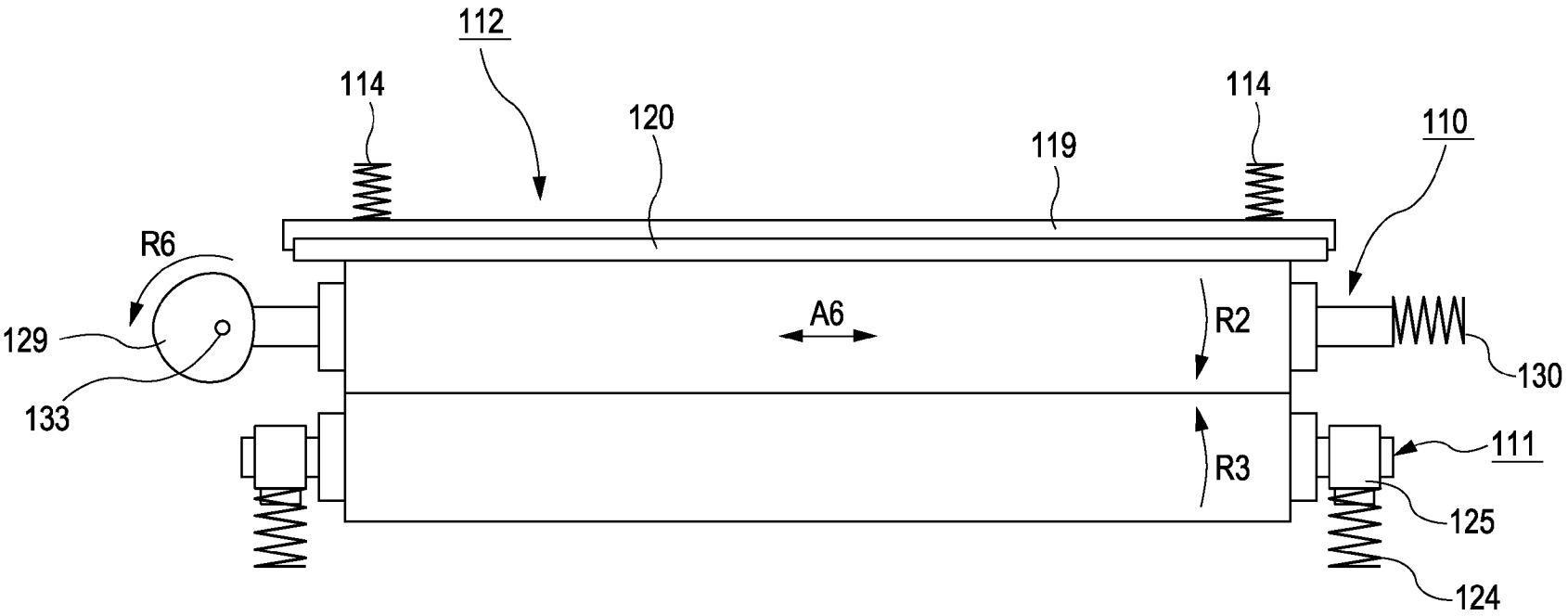
FIG. 9 is a front view of an image heating apparatus according to a modification from the second embodiment in that the fusing roller is slid.

In the configuration according to the embodiment, the fusing roller 110 is fixed and the heating member 112 is reciprocated in the axial direction; alternatively, the heating member 112 may be fixed and the fusing roller 110 may be reciprocated in the axial direction; or the heating member 112 and the fusing roller 110 may be reciprocated relatively to each other. For example, FIG. 9 shows a front view of a configuration in that the heating member 112 is fixed and the fusing roller 110 is reciprocated in the axial direction. In the same way as in the configuration shown in FIGS. 6 and 7 in that the heating member 112 is reciprocated, the heating member 112 may be reciprocated with the cam 129 and the pressure spring 130. The configuration of reciprocating the heating member 112 or the fusing roller 110 is not limited to the above, so that the gear 126 may be to-and-fro rotated using rack and gear (FIG. 2) as in the first embodiment. The reciprocating direction of the heating member 112 or the fusing roller 110 is not limited to the direction in parallel with the axis of the fusing roller, and if the heating member 112 and the fusing roller 110 are slid relatively to each other in a direction different from the rotational direction of the fusing roller 110, the surface of the fusing roller 110 moves relative to the heating member 112 in an oblique direction different from the rotational direction of the fusing roller 110, so that the same benefits as described above can be obtained.

Figure 10:
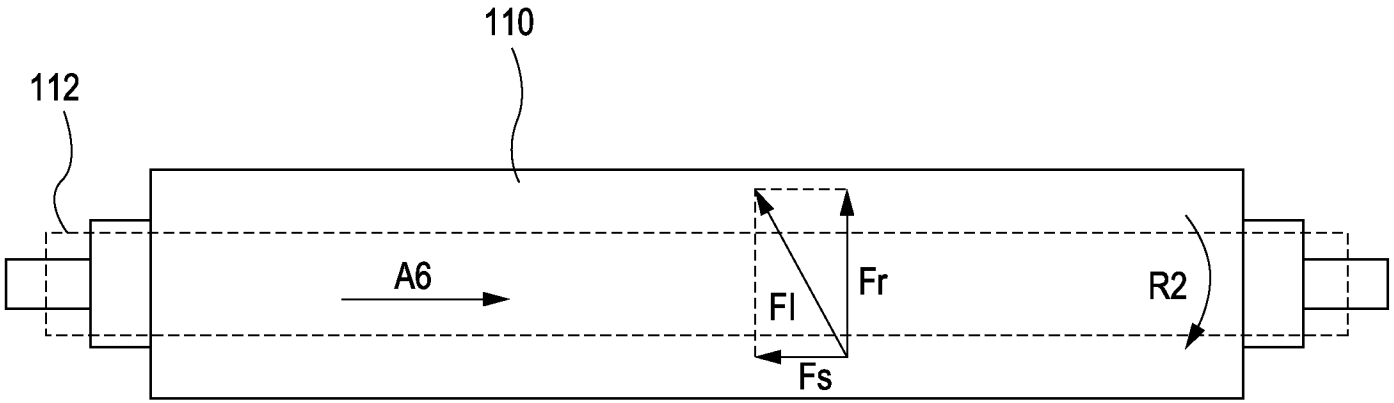
FIG. 10 is a drawing illustrating the frictional force applied to the surface of the fusing roller when the fusing roller rotates in R2 direction as well as slides in A6 direction.

Then, with reference to FIG. 10, the frictional force will be described that is produced by the sliding of the fusing roller 110 over the heating member 112 when the fusing roller 110 is rotated and the heating member 112 moves relative to the fusing roller 110 in a state both the members are arranged in contact with each other. The description below is on the assumption that the heating member 112 is fixed and the fusing roller 110 is reciprocated in the axial direction.

Since the fusing roller 110 is rotating, a frictional force Fr is applied to the surface of the fusing roller at the contact heating head N1 to the heating member 112. Furthermore, since the fusing roller is reciprocated in the axial direction, a frictional force is applied to the surface of the fusing roller in a direction reverse to its moving direction. FIG. 10 shows the frictional force Fs applied during the moving in the A6 direction of the fusing roller 110. A resultant force F1 of these two forces is applied to the surface of the fusing roller. Since the fusing roller 110 is reciprocated, the force F1 has a component in a direction different from the rotational direction, and the force is periodically varied with time.

If the fusing roller and the heating member are not relatively slid in the intersecting direction, if a foreign material, such as dust, is pinched into the contact heating head N1, the foreign material is liable to be retained in the contact heating head N1. Thus, the retained foreign material scrapes away the same position on the surface of the fusing roller, so that this may lead to generate a deep scratch in the rotational direction of the fusing roller.

Whereas, when the fusing roller and the heating member are relatively slid, the frictional force received by the foreign material has a component with a direction different from the rotational direction of the fusing roller as mentioned above, so that if the foreign material might be pinched into the contact heating head N1, it may sneak away the contact heating head N1.

Thus, the foreign material may not scrape away the same position on the surface of the fusing roller, thereby suppressing the deep scratch on the surface of the fusing roller.

Figure 11A:
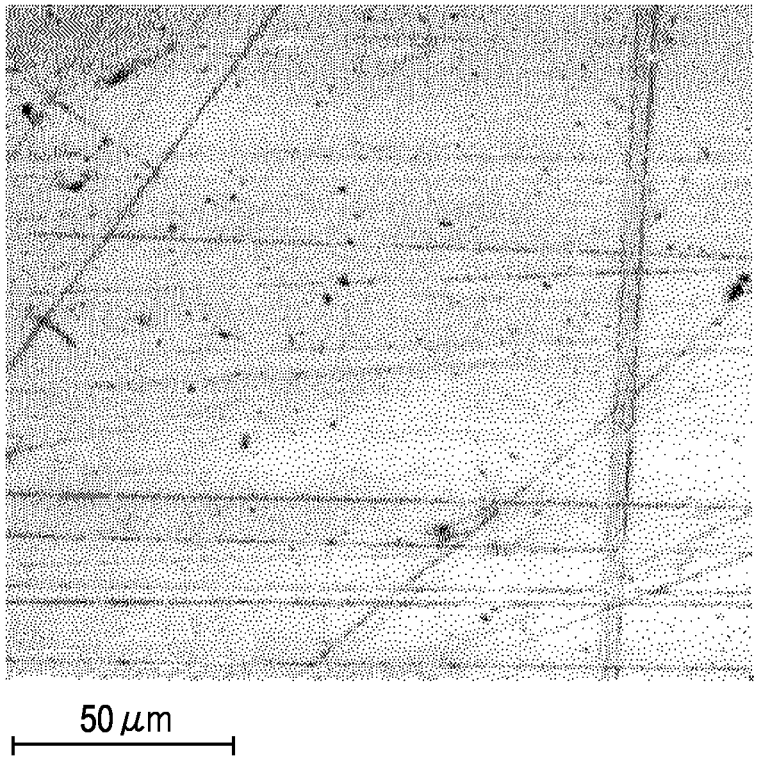
FIG. 11A is a photograph observed with a polarization microscope of the surface of a new fusing roller prior to the mounting on the fusing unit during manufacturing the fusing unit.
Figure 11B:
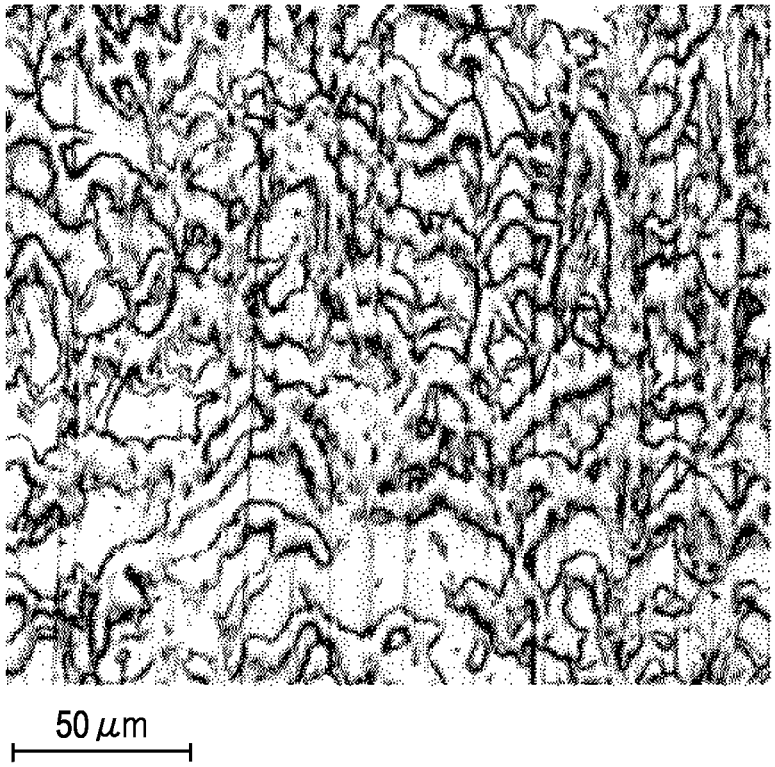
FIG. 11B is a photograph observed with the polarization microscope of the surface of the fusing roller after it is reciprocated for 10 minutes.

The releasing layer 118 on the surface of the fusing roller 110 is partially extended due to the frictional force F1 and the heat from the heating member 112 in an intersecting direction with the rotational direction of the fusing roller so as to make the surface scaly. FIG. 11A is a photograph of the surface of a new fusing roller prior to the mounting on the fusing unit during manufacturing the fusing unit; and FIG. 11B is a photograph of the surface of the fusing roller after it is reciprocated for 10 minutes by the method of the second embodiment. These photographs are results observed with a polarization microscope. As shown in FIG. 11B, the releasing layer 118 extended to be scaly is produced over the whole surface of the fusing roller 110.

Then, the mechanism for repairing the scratch produced on the surface of the fusing roller with the configuration according to the embodiment will be described.

As mentioned above, by covering the scratch on the surface of the fusing roller 110 with part of the releasing layer extended to have a scaly face, the streak becomes difficult to emerge on fixed images. Even this part cannot cover the entire scratches on the surface of the fusing roller 110; it has become clear that the image failure due to the scratch on the fusing roller can be significantly prevented from emerging on fixed images as long as the part partially covers the scratches.

Figure 12:
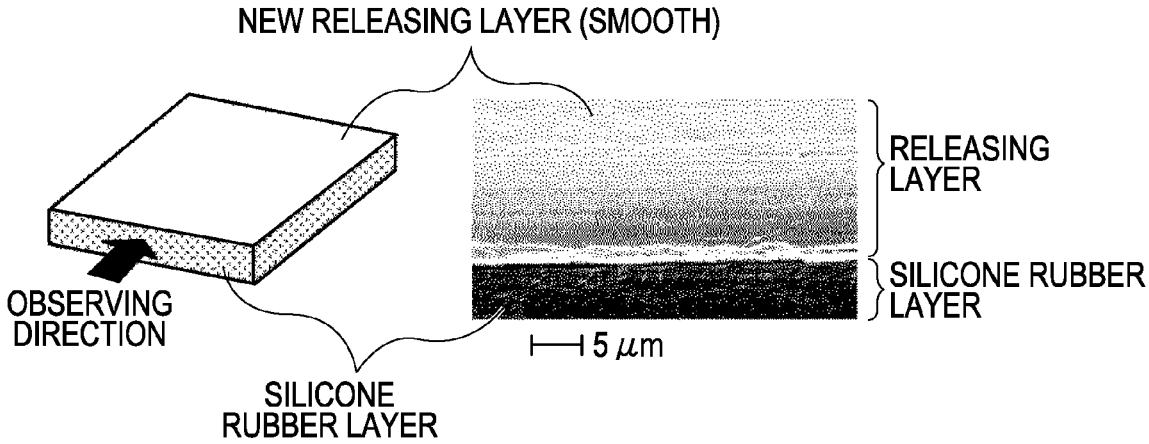
FIG. 12 includes a photograph observed with a scanning electron microscope (SEM) and a schematic drawing of the surface section of the new fusing roller.
Figure 13:
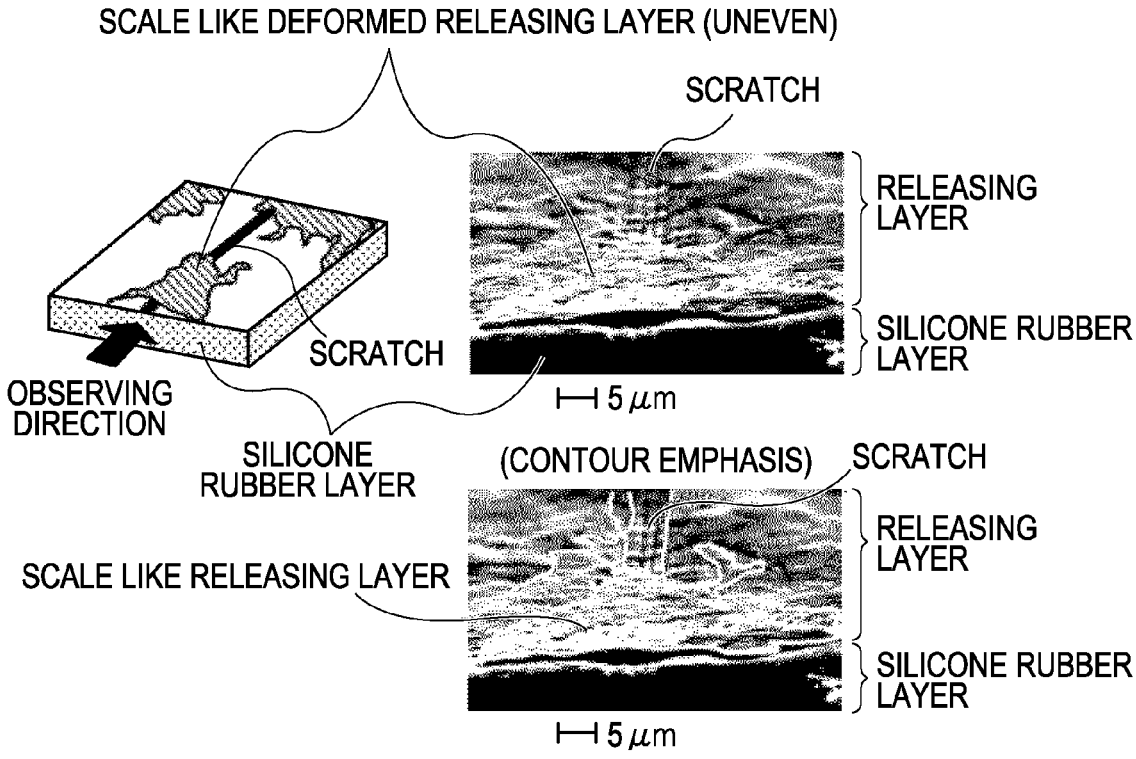
FIG. 13 includes a photograph observed with a scanning electron microscope (SEM) and a schematic drawing of the surface section of the fusing roller after it is reciprocated relatively to the heating member in a heating state and is slidably rubbed.

FIGS. 12 and 13 show the section of the surface of the fusing roller 110 observed with a scanning electron microscope (SEM), in which FIG. 12 shows a photograph and a schematic drawing illustrating the observed surface layer of a new fusing roller; FIG. 13 illustrating the observed surface layer of the fusing roller after it is reciprocated relatively to the heating member 112 and is slidably rubbed.

While the surface layer (the releasing layer) of the new fusing roller is smooth, as shown in FIG. 12, the surface layer (the releasing layer) of the fusing roller after being slidably rubbed has the partially extended part having the scaly face, and it is understood that the transformed part covers scratches, as shown in FIG. 13.

As described above, for partially extending the releasing layer 118 to have the scaly face, the frictional force and the temperature are necessary for softening and extending the surface (the releasing layer) of the fusing roller 110.

First, the frictional force applied to the surface of the fusing roller 110 includes the frictional force F1 generated due to the sliding between the fusing roller 110 and the heating member 112, as described above. For obtaining the frictional force F1, according to the embodiment, the peak value of the normal pressure at the contact heating head N1 is set at 1.2×105 $N/m^2$. For obtaining the frictional force F1 efficiently extending the releasing layer 118 to have the scaly face, it is desirable that the peak value of the normal pressure at the contact heating head N1 be at least 9.8×104 $N/m^2$.

Then, the temperature for effectively extending the releasing layer 118 to have the scaly face requires a temperature at the glass transition point (Tg) or more. The temperature at the glass transition point of PFA used for the releasing layer according to the embodiment is about 118° C., so that as long as the temperature is 180° C., which is the temperature set for the heating member during fusing in the fusing unit according to the embodiment, the releasing layer 118 can be efficiently extended to have the scaly face during the fusing.

Even if both the fusing roller 110 and the heating member 112 are fixed not to slide and the fusing roller 110 and the heating member 112 are slid only in the rotational direction, since the conditions of the frictional force and the temperature mentioned above are satisfied, the releasing layer 118 is partially extended to have the scaly face; however, the benefits of repairing scratches like in the embodiment cannot be obtained, and its reasons will be described below.

As described above, in the configuration in that both the fusing roller 110 and the heating member 112 are fixed not to slide, the frictional force Fr applied to the surface of the fusing roller 110 is directed only in the rotational direction. In this case, the releasing layer 118 is extended in the rotational direction to have the scaly face, so that the extended portion scarcely covers scratches deeply produced in the rotational direction. Thus, the scratches cannot be repaired.

Figure 14A:
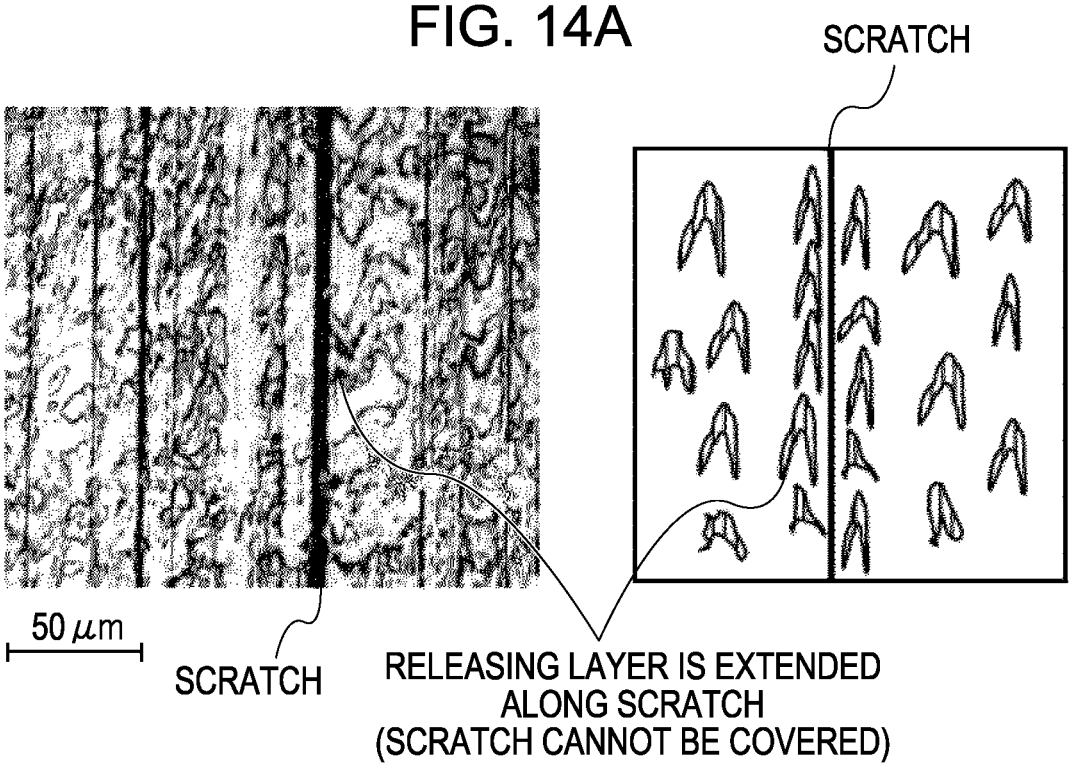
FIG. 14A includes a photograph observed with a polarization microscope and a schematic drawing of the surface of the fusing roller after it is rotated in a comparative example configuration in that both the fusing roller and the heating member are fixed not to slide in the axial direction.
Figure 14B:
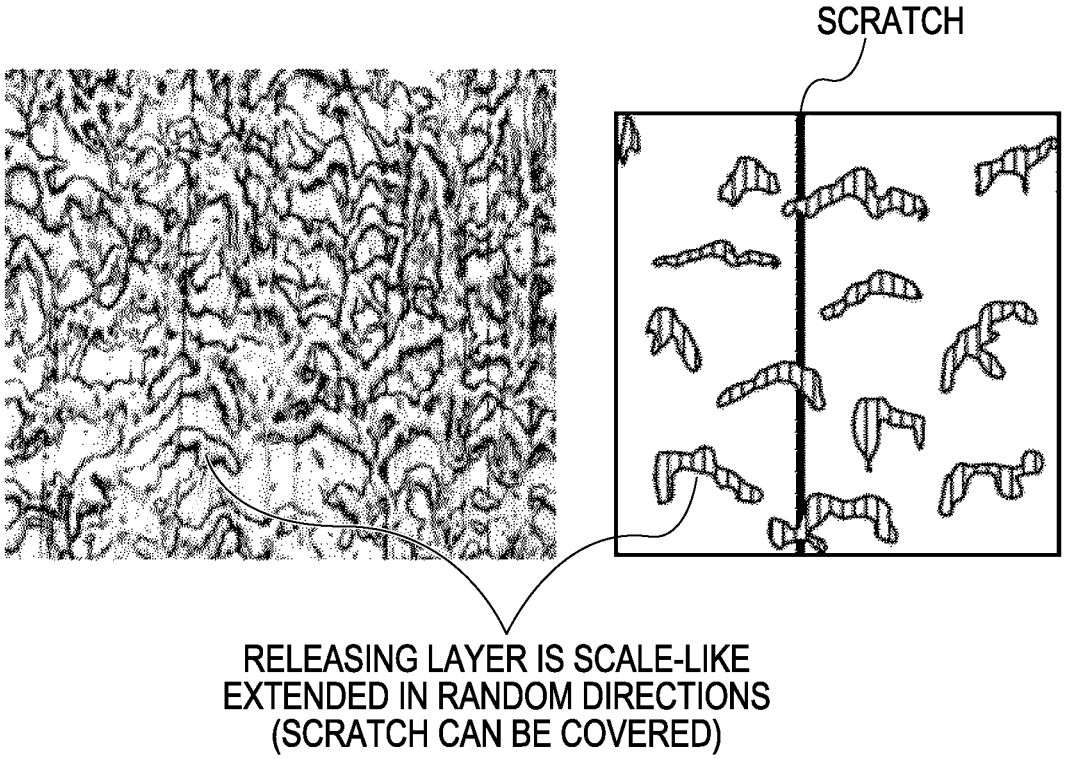
FIG. 14B includes a photograph observed with the polarization microscope and a schematic drawing of the surface of the fusing roller after it is rotated in the configuration according to the embodiment in that the fusing roller and the heating member are relatively moved in the axial direction.

FIGS. 14A and 14B compare the surface after the fusing roller is rotated in the comparative example configuration in that both the fusing roller 110 and the heating member 112 are fixed not to slide in the axial direction with the surface after the fusing roller is rotated in the configuration according to the embodiment in that the fusing roller 110 and the heating member 112 are relatively moved in the axial direction. The photographs in the drawings are images observed with a polarization microscope and schematic drawings are shown adjacent to the photographs for simply illustrating the state of the surface layer. Both the comparative example and the example show the surface state after the fusing unit is driven for 10 minutes in a state that the surface temperature of the fusing roller 110 (≈the target temperature of the heating member) is maintained at 180 C.°.

As shown in FIG. 14A, in the comparative example, the releasing layer 118 is extended to have the scaly face in the same direction as that of the scratch, so that the scaly portion does not cover the scratch and the scratch itself is enlarged and deepened.

On the other hand, according to the embodiment, the fusing roller 110 is reciprocated in the axial direction and the heating member and the fusing roller are relatively moved in the intersecting direction with the rotational direction of the fusing roller, so that the frictional force applied to the surface (the releasing layer) of the fusing roller 110 has a component directed in a direction different from the rotational direction. Accordingly, as shown in FIG. 14B, since the releasing layer 118 is extended to have a scaly face in random directions other than the rotational direction, the scaly portion covers the scratch generated in the rotational direction and it is understood that the scratch is repaired. Also, the scratch itself becomes smaller and shallower in comparison with that shown in FIG. 14A.

When the releasing layer on the surface of the fusing roller 110 is transformed to have the scaly face, even if a foreign material is tentatively retained at the contact heating head N1 to rub the surface of the fusing roller, the scratch breaks off intermittently by the scaly portion of the releasing layer so as to also have a benefit in that the scratch is difficult to be transferred onto images on the recording member.

Even in the configuration in that the fusing roller 110 is reciprocated like in the example, there is provided a function to extend the releasing layer 118 on the fusing roller 110 to have a scaly face in random directions other than the rotational direction (the intersecting direction with the rotational direction), so that the surface roughness (10-point roughness average Rz) of the fusing roller 110 can be reduced, due to the above-mentioned scratch suppressing effect and scratch repairing effect, below 3 μm until 100,000 sheets that correspond to the life of the fusing unit. Therefore, even when forming solid images on glossy paper, on which the streak due to the scratch in the rotational direction on the fusing roller is liable to emerge on images on the recording member, the image failure can be suppressed.

Even when scaly irregularities are formed on the surface layer of the fusing roller with the configuration according to the embodiment, the adverse effect due to the scaly portion, such as reduced glossiness of the fixed images, is difficult to occur. The reason is that the releasing layer is sufficiently extended due to the heat and the frictional force during the transforming to have the scaly face, so that the scaly portion does not become sharp steps that reduce the glossiness of the fixed images.

Figure 15:
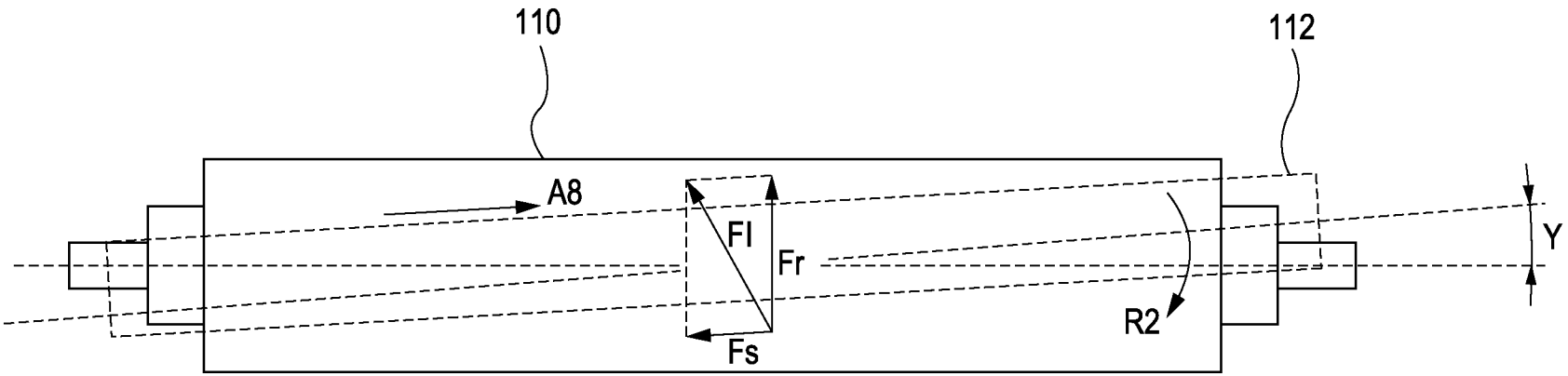
FIG. 15 is a drawing illustrating the frictional force applied to the surface of the fusing roller when the fusing roller rotates in R2 direction as well as slides in A8 direction in the configuration in that the reciprocating direction of the heating member is shifted to the axial direction of the fusing roller by an angle Y.

The direction reciprocating the fusing roller 110 or the heating member 112 is not limited to the axial direction. For example, the reciprocating direction of the heating member 112 may also be shifted from being in parallel with the rotational axis of the fusing roller 110. FIG. 15 is a plan view of the configuration in that the reciprocating direction of the heating member 112 is shifted by an angle of Y to the axial direction of the fusing roller 110 viewed from the top of the unit. Even with this configuration, the frictional force Fr due to the rotation of the fusing roller 110 and the frictional force Fs due to the reciprocating of the heating member 112 are produced (in the drawing, a case where the heating member 112 moves in the A8 direction is shown). The resultant force F1 of the frictional forces Fr and Fs has a component in a direction other than the rotational direction of the fusing roller 110, so that the scratch can be suppressed and even if the scratch is generated, it can be repaired.

If the shifting angle Y of the rotational axis of the fusing roller 110 to the longitudinal direction is excessively large, the heating member is difficult to uniformly abut the surface of the fusing roller 110 along the axial direction (the generating line direction), so that it is desirable that the angle Y be set in the range of $0° \leqq Y \leqq 10°$. According to the embodiment, $Y=5°$.

According to the embodiment, a PTFE fluororesin sheet is used in the sliding layer 120; alternatively, a metallic sheet, such as aluminum (AL) and stainless steel (SUS), may also be used for efficiently transferring the heater heat to the fusing roller 110.

As described above, when a movement mechanism is provided in that at least one of the fusing roller and the heating member can be reciprocated in a direction intersecting with the rotational direction of the fusing roller in a state of both the members arranged in contact with each other, foreign materials in the contact heating head can be prevented from scratching the same position on the surface of the fusing roller in the axial direction. When at least one of the fusing roller and the heating member is also configured to reciprocate in the intersecting direction during the heating the fusing roller by the heating member, scratches on the surface of the fusing roller can be effectively repaired. It is particularly preferable that such reciprocating movement be performed during heating (fusing) a recording member carrying images thereon, because of no necessity for additional time for repairing the scratches. In such a manner, when the fusing unit has a function to partially extend the surface of the fusing roller in a direction intersecting with the rotational direction of the fusing roller so as to transform the surface to be scaly, a frictional force is applied to the surface of the fusing roller in the intersecting direction, so that a scaly releasing layer is formed to have scratch repairing benefits.

Third Embodiment

A third embodiment of the present invention will be described below. In this embodiment, the image forming apparatus is generally provided for forming unfixed toner images in the same way as in the first embodiment, so that its description is omitted. As for the contact-type externally heating fusing unit, like reference numerals and symbols designate like components common to the first embodiment and the description is omitted. According to the embodiment, at the contact heating head N1, the surface of the fusing roller 110 is moved relative to the heating member 112 in a direction different from the rotational direction of the fusing roller 110 (the intersecting direction), so that the heating member 112 is rotated in a direction different from the rotational direction of the fusing roller 110. This will be described below in detail.

Figure 16:
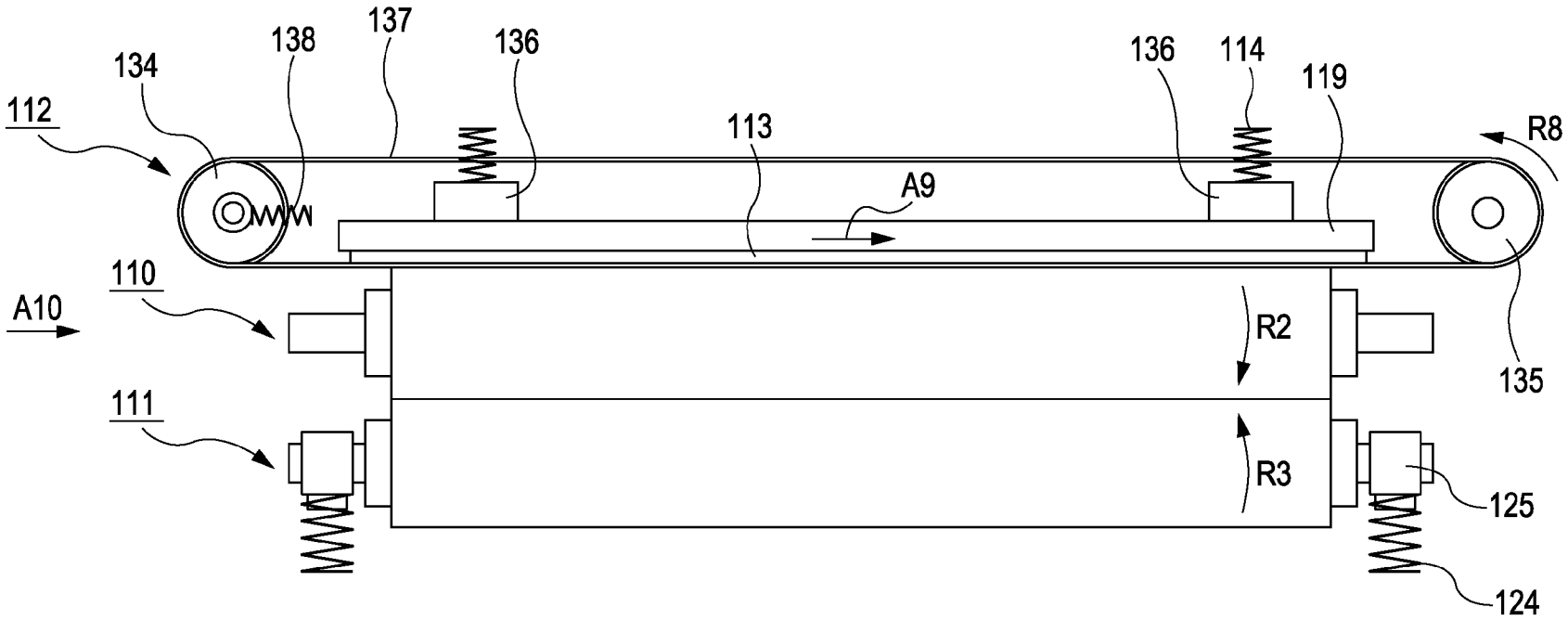
FIG. 16 is a front view of an image heating apparatus according to a third embodiment.

FIG. 16 is a front view of the contact-type externally heating fusing unit according to the embodiment. In the same way as in the first embodiment, the fusing roller 110 is fixed not to move in the axial direction, and by the rotation of the fusing roller 110 in arrow R2 direction, the pressure roller 111 is rotated to follow the fusing roller 110 in arrow R3 direction.

In the heating member 112, the heater 113 is held in the heater holder 119 as a heat source, and in its portion of contact with the fusing roller 110, a belt sliding layer 137 is provided.

The sliding layer 137 is stretched between a driving roller 135 and a tension roller 134, and is pulled with a tension spring 138 under a load of 9.8N.

Figure 17:
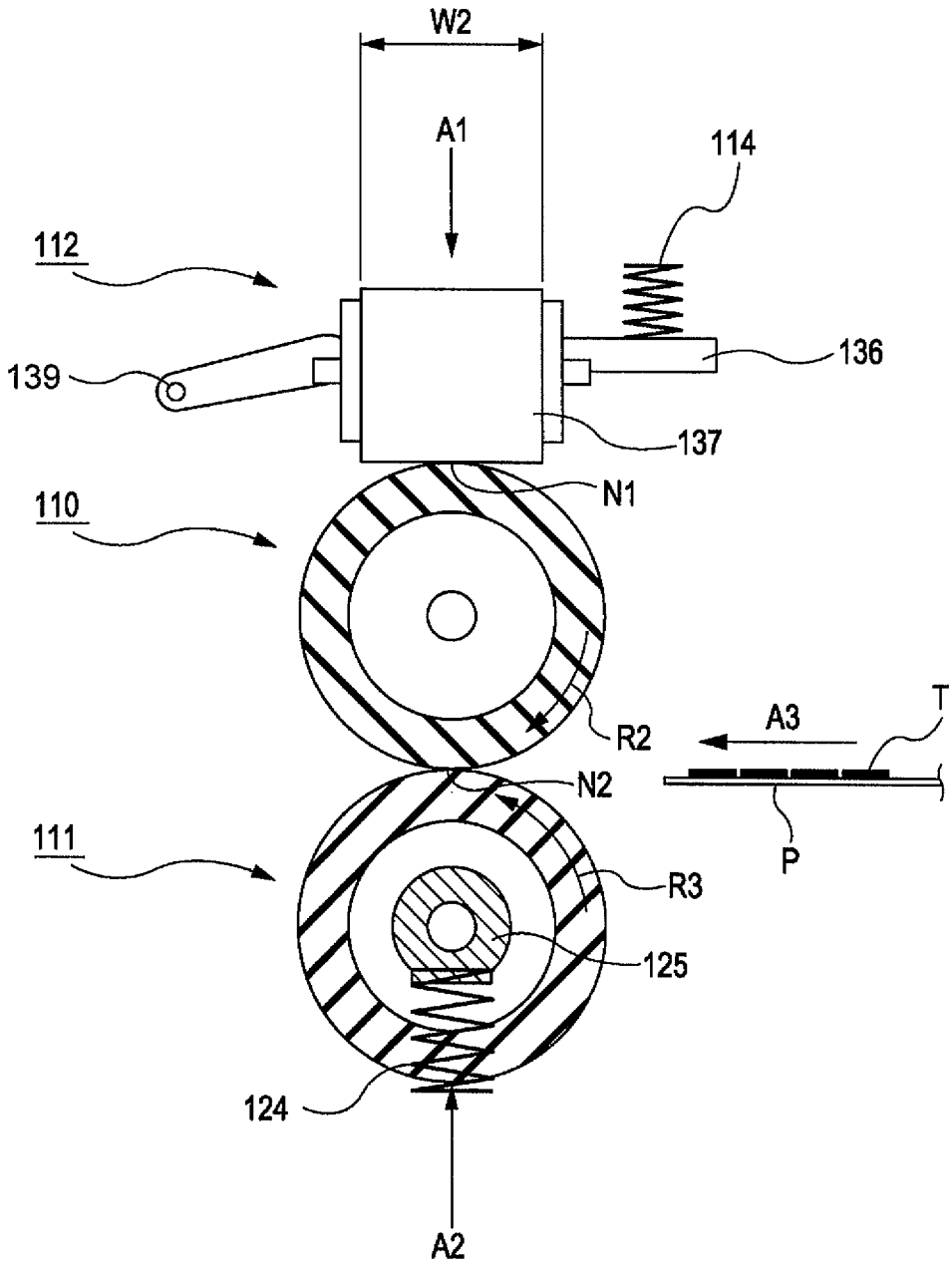
FIG. 17 is a sectional view of the image heating apparatus according to the third embodiment.

FIG. 17 is a side view of the fusing unit viewed in arrow A10 direction in FIG. 16. The width W2 of the sliding layer 137 is 15 mm, and the heater holder 119 and the heater 113 with a width of 6 mm are covered with the sliding layer 137. The heating member 112 is pressurized by rotating two pressure plates 136, which extend between belts of the sliding layer 137, about fulcrums 139 under the force of pressure springs 114. The force for pressurizing the heater holder 119 in arrow A1 direction with the pressure springs 114 is 98N. During the rotation of the fusing roller 110, the driving roller 135 is rotated in arrow R8 in FIG. 16 while the sliding layer 137 is rotated in arrow A9 direction. Thus, in the same way as in the first embodiment, the surface of the fusing roller 110 is moved relative to the heating member 112 in a direction different from the rotational direction R2 of the fusing roller 110, so that a scratch with such depth that the scratch emerges as a streak on images can be restrained from being generated on the surface of the fusing roller 110. In the same way as in the first embodiment, scratches generated on the surface of the fusing roller 110 can also be effectively repaired. In the configuration according to the embodiment, since the rotational movement is used for moving the heating member 112 in the axial direction, the heating member 112 can be slid semi-permanently and independently of the longitudinal length of the member to be moved in the longitudinal direction.

On the configuration described above, the print endurance was tested in the same way as in the first embodiment. The surface of the fusing roller 110, in the same way as in the first embodiment, is moved relative to the heating member 112 in a direction different from the rotational direction of the fusing roller 110 by the rotating movement of the heating member 112 in the axial direction, so that the depth Rz of the scratch on the surface of the fusing roller 110 can be reduced below 3 μm. Thus, the image failure, such as a streak, can be suppressed until the end of the fusing unit life independently of the kind of paper and the print coverage rate, in the same way as in the first embodiment.

Fourth Embodiment

A fourth embodiment of the present invention will be described below. In this embodiment, the image forming apparatus is generally provided for forming unfixed toner images in the same way as in the first embodiment, so that its description is omitted. As for the contact-type externally heating fusing unit, like reference numerals and symbols designate like components common to the first embodiment and the description is omitted.

In the configuration according to the third embodiment, the heating member 112 is rotated in the axial direction of the fusing roller; however, the rotational direction of the heating member 112 is not limited to the axial direction, so that as long as the direction is different from the rotational direction of the fusing roller 110, the same benefits as described above can be obtained. For example, as shown in FIG. 18, in a contact-type externally heating unit using a rotatable body, such as a heat roller, containing a halogen lamp, as the heating member 112, the rotational axis of the heating member 112 may also be shifted to that of the fusing roller 110.

Figure 18:
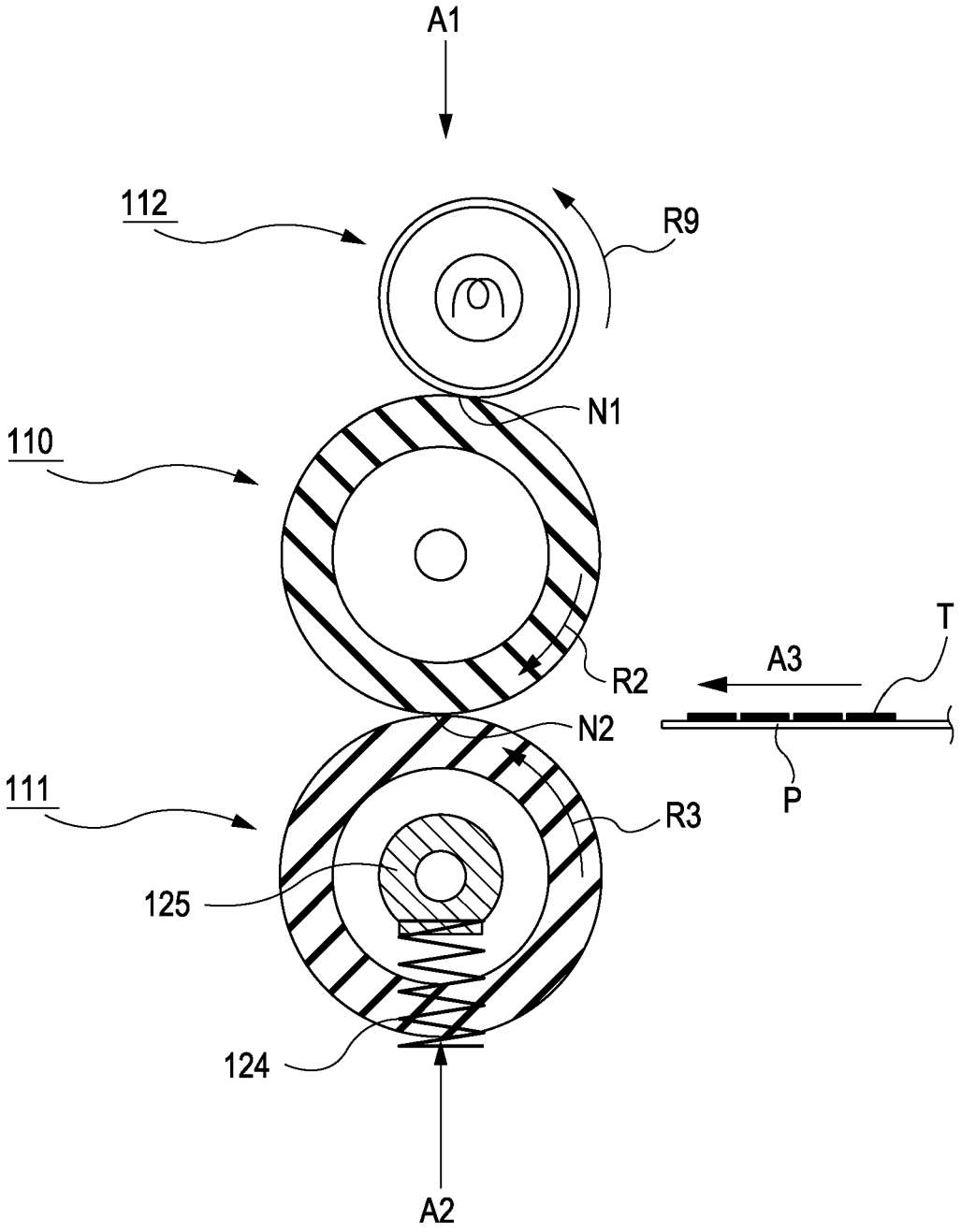
FIG. 18 is a sectional view of an image heating apparatus according to a fourth embodiment.
Figure 19:
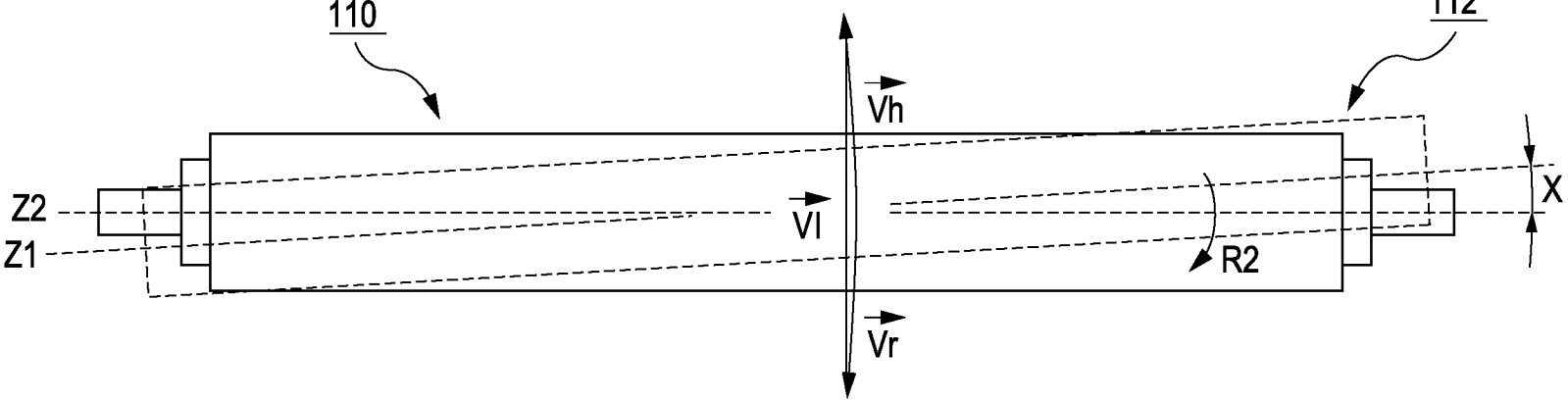
FIG. 19 is a drawing illustrating the frictional force applied to the surface of the fusing roller in the image heating apparatus according to the fourth embodiment.

FIG. 19 is a drawing of the fusing unit viewed in arrow A1 direction of FIG. 18. The rotational axis Z1 shown by a dotted line of the heating member 112 is shifted to the rotational axis Z2 of the fusing roller 110. When viewing the surface of the fusing roller 110 from the heating member 112, the surface of the fusing roller 110 moves in a vector sum direction V1 (=Vr+Vh) of the rotational movement Vr of the fusing roller 110 in the R2 direction and the rotational movement Vh of the heating member 112 in the R9 direction. The surface of the fusing roller 110 constantly moves relative to the heating member 112 in the oblique direction V1 different from the rotational direction R2 of the fusing roller 110. As the shifting angle X between the axis Z1 of the heating member 112 and the rotational axis Z2 of the fusing roller 110 becomes larger, the displacement in the direction V1 increases so that the scratch suppressing and scratch repairing benefits are increased; however, if it is excessively large, the contact heating head formed by the heating member 112 and the fusing roller 110 becomes ununiform along the axial direction of the fusing roller. Therefore, it is desirable that the angle X be in a range of $1° \leqq X \leqq 15°$, and according to the embodiment, $X=5°$.

In the external heating unit according to the embodiment, since the moving direction of the surface of the heating member 112 (the surface of the heating roller) is identical to that of the surface of the fusing roller 110, scratches are originally difficult to be generated on the fusing roller 110 in the rotational direction. However, when a lot of small-sized paper is processed, scratches may be produced due to paper edges on the fusing roller 110 in the rotational direction. In the configuration according to the embodiment, the surface of the fusing roller 110 constantly moves relative to the heating member 112 in the direction V1 different from the rotational direction R2 of the fusing roller 110, so that the scratch on the surface of the fusing roller 110 can be effectively suppressed and repaired. Therefore, even when a lot of small-sized paper is processed, a scratch with such a depth that the scratch emerges as a streak on images can be restrained from being generated on the fusing roller. Even if a scratch is generated with such a depth that the scratch emerges as a streak on images, the generated scratch can be repaired with the configuration according to the embodiment.

Fifth Embodiment

A fifth embodiment of the present invention will be described below. In this embodiment, the image forming apparatus is generally provided for forming unfixed toner images in the same way as in the first embodiment, so that its description is omitted. As for the contact-type externally heating fusing unit, like reference numerals and symbols designate like components common to the first embodiment and the description is omitted. According to the embodiment, a fusing belt 135 is used as a rotational body arranged in contact with a recording member carrying images thereon.

Figure 20:
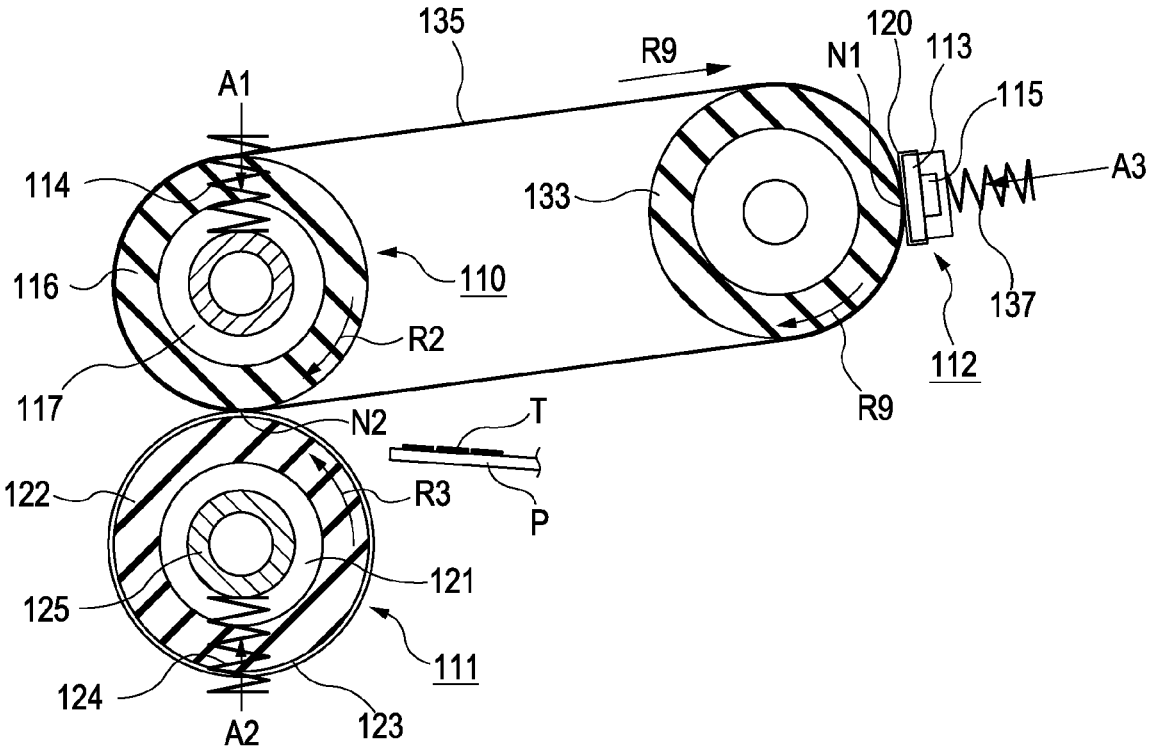
FIG. 20 is a sectional view of an image heating apparatus according to a fifth embodiment.

FIG. 20 is a schematic sectional view of the contact-type externally heating fusing unit according to the embodiment. The fusing roller 110 is fixed not to move in the axial direction, and is rotated in arrow R2 direction. The fusing belt 135 as the rotational body arranged in contact with the recording member is stretched between the fusing roller 110 and a tension roller 133, and is rotated to follow the fusing roller 110 in arrow R9 direction. The pressure roller 111, which forms the fusing nip N2 with the fusing belt 135 therebetween in cooperation with the fusing roller 110, rotates to follow the fusing belt 135 in arrow R3 direction.

For efficiently warming up the fusing belt 135, the heating member 112 is arranged in contact with the surface of the fusing belt 135. The contact zone between the fusing belt 135 and the heating member 112 is to be the contact heating head N1. The force pushing the heating member 112 in arrow A3 direction with a pressure spring 137 is set at 98N.

Figure 21:
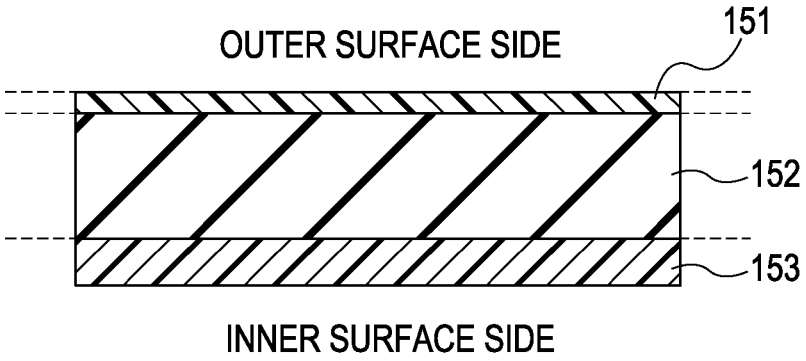
FIG. 21 is a sectional view of a fusing belt used in the image heating apparatus according to the fifth embodiment.

With reference to FIG. 21, the layer structure of the fusing belt 135 used in the fusing unit according to the embodiment will be described. The layer structure of the fusing belt 135 is composed of a polyimide resin base layer 153, a primer layer (adhesive line), an elastic layer 152, and a fluororesin releasing layer 151 disposed in that order from the inner surface.

The elastic layer 152 is made of a material excellent in heat endurance and heat conduction such as silicone rubber, fluororubber, and fluorosiliconeruber. According to the embodiment, solid silicone rubber with a coefficient of thermal conductivity of 0.25 W/mK to 0.29 W/mK is used. The material of the releasing layer 151 is a perfluoroalkoxy resin (PFA).

When a recording member P having unfixed toner images T transferred thereon is conveyed into the fusing nip N2 by a conveyer (not shown), the heat on the surface of the fusing belt 135 is transferred to the unfixed toner images T and the recording member P, so that the toner images T are fixed on the recording member P.

When using a belt-type rotational body arranged in contact with a recording member carrying images thereon like in this embodiment, a scratch is liable to be generated on the surface of the rotational body due to the heating member being in contact therewith.

Figure 22:
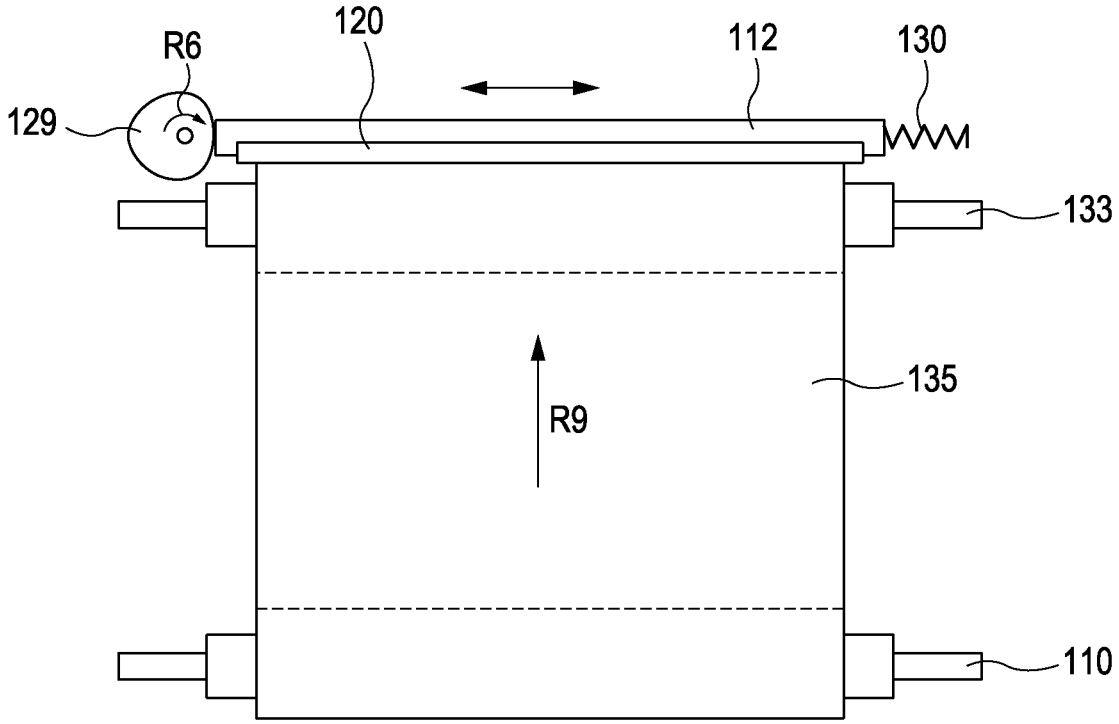
FIG. 22 is a plan view of the image heating apparatus according to the fifth embodiment.

Then, according to the embodiment, there is provided a unit configured to partially extend the surface layer of the fusing belt to be scaly. The unit includes a mechanism for bilaterally reciprocating the heating member 112 in the axial direction of the tension roller 133. FIG. 22 is a plan view of the fusing unit according to the embodiment. Since the mechanism for bilaterally reciprocating the heating member 112 is exactly the same as that of the second embodiment, the detailed description is omitted. With the rotation of the cam 129 and the pressure spring 130, the heating member 112 is reciprocated in the axial direction of the tension roller 133 while by a control unit (not shown), the fusing belt 135 is maintained to have a high temperature of 180°, so that the surface layer of the fusing belt 135 can be extended to be scaly in random directions.

As described above, with the above unit, the releasing layer 118 of the fusing belt 135 is extended to be scaly in a direction different from the rotational direction of the fusing belt 135, so that a scratch is difficult to be generated on the surface layer of the fusing belt 135 and if it is generated, the scratch can be repaired.

According to the embodiment, the fusing roller 110 is rotated by a driving source and the tension roller 133 and the pressure roller 111 follow the fusing roller 110; alternatively, the tension roller 133 and the pressure roller 111 may be rotated by a driving source and other rollers may follow the tension roller 133 and the pressure roller 111.

According to the embodiment, the whole heating member 112 is reciprocated; alternatively, only the sliding layer 120 of the heating member 112 may be moved to have a sliding component in a direction different from the rotational direction of the tension roller 133.

In the embodiments described above, the fusing unit to be mounted on an image forming apparatus is exemplified; however, the image heating apparatus according to embodiments is not limited to the fusing unit to be mounted on an image forming apparatus. For example, a glossiness applicator available as an optional unit for again heating the images, which have been fixed by the fusing unit, for improving image glossiness can also be applied to the technical spirit of the invention. The invention can incorporate an image heating apparatus having both the heating member arranged in contact with the surface of the rotational body and the heating member (a halogen heater, for example) arranged inside the rotational body. Regardless of the application and the unit conformation, the present invention can incorporate an image heating apparatus having a rotational body arranged in contact with a recording member carrying images thereon, a heating member arranged in contact with the surface of the rotational body for heating the rotational body, and a backup member for forming a nip for pinching and conveying the recording member carrying images thereon in corporation with the rotational body.

Sixth Embodiment

Then, an image heating apparatus having a heat source inside a rotational body will be described.

[Fusing Unit (Image Heating Apparatus)]

It is the purpose of a fusing unit 100 according to a sixth embodiment to suppress the image failure due to scratches generated on a releasing layer, such as "low glossy streaks in a passage way of paper edges", "the glossiness difference between a paper passage part and a non-paper passage part" and "vertical streaks due to dust and a foreign material", which have been described in Description of the Related Art.

Figure 24:
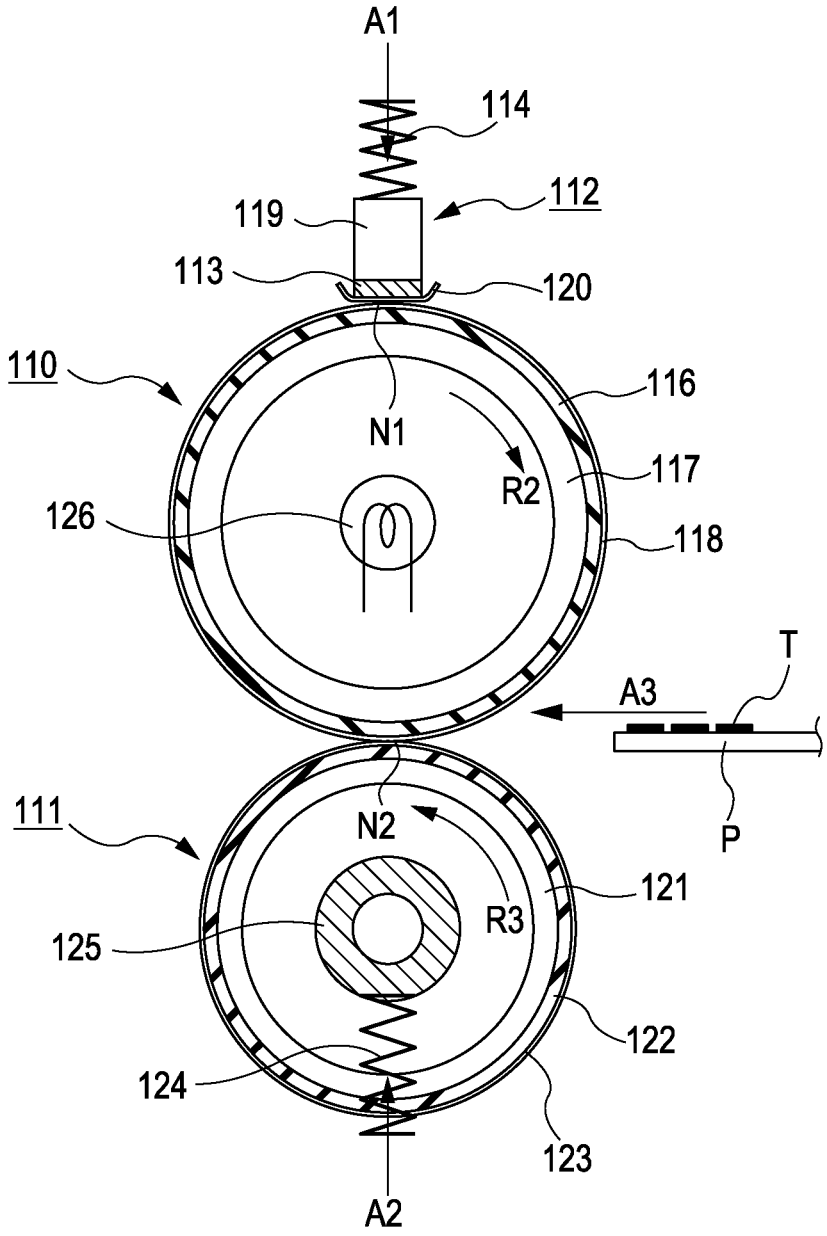
FIG. 24 is a conceptual drawing of a fusing unit according to a sixth embodiment.

FIG. 24 is a schematic sectional view of the fusing unit according to the embodiment. Referring to FIG. 24, the fusing roller (a rotational body having the releasing layer on its surface) 110 is composed of an aluminum hollow core grid (a base layer) 117 with a diameter of 68 mm, an elastic layer 116 made of silicone rubber with rubber hardness 20° (JIS-A a load of 1 kg) and a thickness of 1.0 mm, and the releasing layer 118 made of a perfluoroalkoxy resin (PFA) with a thickness of 30 μm disposed in that order from the inside to have the releasing layer 118 with a diameter of 70 mm. The releasing layer 118 may be a cover tube or a coating material for the surface, whereas, according to the embodiment, a tube excellent in durability is used. The material of the releasing layer 118, in addition to PFA, may include a fluororesin, such as a polytetrafluoroethylene resin (PTFE) and a tetrafluoroethylene/hexafluoropropylene resin (PFA).

As the surface hardness of the fusing roller 110 is low, the significant width of the contact heating head N1 can be obtained even under low pressure; however, if the surface hardness of the fusing roller 110 is excessively low, the durability is deteriorated, whereas, according to the embodiment, the hardness is set at an Asker-C hardness (load: 4.9N) of 40 to 45°.

The used pressure roller 111 (the backup member) is composed of an aluminum hollow core grid 121 with a diameter of 48 mm, an elastic layer 122 made of silicone rubber with rubber hardness 20° (JIS-A a load of 1 kg) and a thickness of 1.0 mm, and a releasing layer 123 made of a fluororesin with a thickness of 30 μm that are disposed in that order from the inside to have a diameter of 50 mm. The pressure roller 111 is pressurized with pressure roller pressing springs 124 via bearings 125 under a force of 800N to come in contact with the fusing roller 110 for forming the fusing nip N2 with a width of 10 mm in corporation with the fusing roller 110 and rotating to follow the fusing roller 110 (in arrow R3 direction in the drawing).

The fusing roller 110 includes a halogen heater (a heating unit) 126 disposed inside the roller as a heating source, and is maintained at 180 C.° by a temperature control circuit (not shown). The fusing roller 110 is also rotated by a rotating unit (not shown) in arrow R2 direction in the drawing at a surface velocity of 220 mm/sec.

On the outer circumferential surface of the fusing roller 110, a sliding member 112 is disposed in contact therewith to slide over the fusing roller 110 for forming the contact heating head N1, the sliding member 112 extending the releasing layer in a direction intersecting with the rotational direction of the rotational body so as to transform the releasing layer to be scaly.

The sliding member 112 includes a sliding-part heat storage member 113 held by an insulating holder 119 and the sliding layer 120 disposed at a contact part with the fusing roller 110. The sliding member 112 is pressurized by pressure roller pressing springs 114 in arrow A1 direction in the drawing under a force of 180N to form the contact heating head N1 having a width of 10 mm. The used sliding-part heat storage member 113 includes an alumina substrate having a width of 12 mm and a thickness of 1 mm and a glass protection layer with a thickness of 50 μm for covering the substrate. The surface of the fusing roller 110 may be heated by bringing the glass surface of the sliding-part heat storage member 113 into direct contact with the surface of the fusing roller 110; whereas, according to the embodiment, the sliding layer 120 excellent in releasing and sliding properties is provided on the surface of the sliding-part heat storage member 113. This sliding layer 120 prevents toner shifted on the surface of the fusing roller 110 from adhering the sliding member 112 as well as the sliding layer 120 reduces the frictional force due to the sliding over the fusing roller 110. The material of the sliding layer 120 may suitably include a fluoreresin such as PFA excellent in releasing properties and PTFE excellent in sliding properties. Since in the sliding layer 120, if it is excessively thick, the sliding-part heat storage member 113 is difficult to store heat while if it is excessively thin, the durability is reduced, it is desirable that the thickness be about 1 to 100 μm. As for the sliding layer 120, the sliding-part heat storage member 113 may be directly coated with a fluoreresin for reducing the contact heat resistance; alternatively, a sheet-like sliding layer excellent in durability and surface properties may be used. When the sheet-like sliding layer is used, since it can be arranged to cover edges of the sliding part heat storage member 113 on up-and-down streams sides, the sliding layer 120 can advantageously protect the fusing roller 110 from the edges of the sliding-part heat storage member 113. According to the embodiment, a PFA sheet with a thickness of 50 μm is used as the sliding layer 120 and it is arranged to cover the edges of the sliding-part heat storage member 113.

When a recording member P having unfixed toner images T transferred thereon is introduced into the fusing nip N2 by a conveying unit (not shown), the heat on the surface of the fusing roller 110 is transferred to the unfixed toner images T and the recording member P so that the toner images T are fixed on the surface of the recording member P.

Then, the unit for extending the releasing layer 118 on the surface of the fusing roller so as to transform the releasing layer to be scaly as a feature of the present invention, the scratch suppression/the scratch repairing benefits, and the maintaining of high surface properties will be described below.

Figure 25:
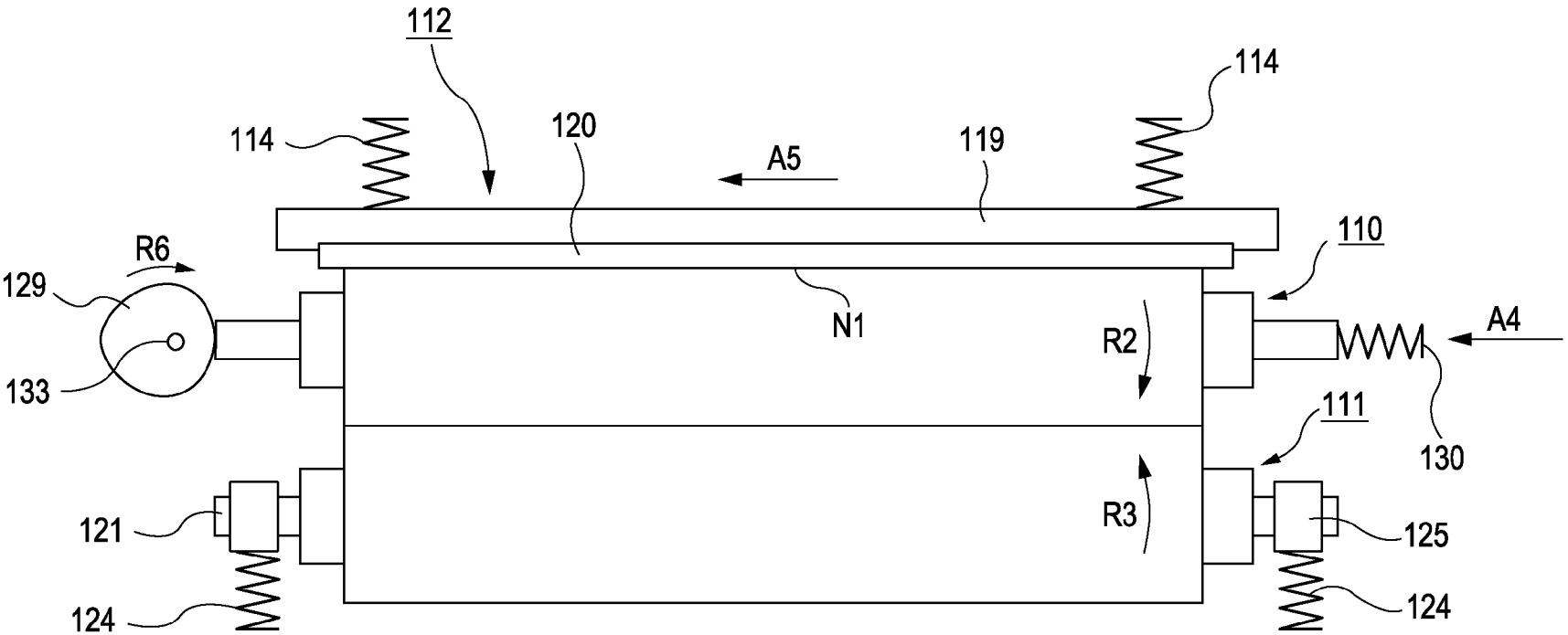
FIG. 25 is a schematic front view of the fusing unit according to the sixth embodiment.

FIG. 25 is a front view of the heating fusing unit according to the embodiment. The sliding member 112 is fixed and by the rotation of the fusing roller 110 in arrow R2 direction, the pressure roller 111 fixed in the axial direction is rotated in arrow R3 direction to follow the fusing roller 110. The fusing roller 110 can move (slide) in the axial direction (the generating line direction), and the fusing roller 110 is slid by the pressure spring 130 pressuring the fusing roller 110 in arrow A4 direction from one side under a load of 49N. On the other hand, the slide cam 129 is provided at a position of the fusing roller 110 opposite to the pressure spring 130, and is to be rotated about a slide cam shaft 133 in arrow R6 direction with a rotating unit (not shown).

Figure 26:
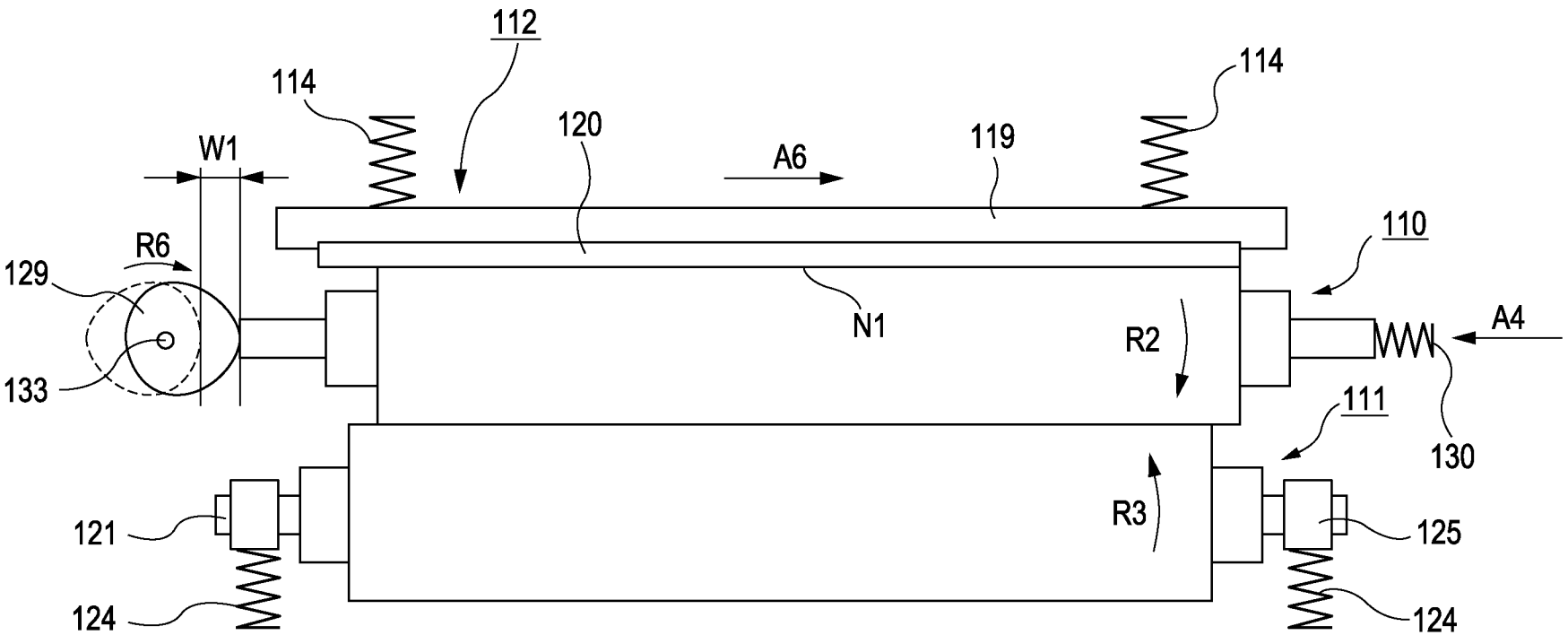
FIG. 26 is a schematic front view of the fusing unit according to the sixth embodiment (a slide cam is rotated by 180°).

FIG. 26 shows the slide cam 129 rotated by 180° from the phase shown in FIG. 25. When the slide cam 129 rotates by 180°, the fusing roller 110 is slid in arrow A6 direction by the slide cam 129 pushing the fusing roller 110. When the slide cam 129 further rotates by 180° in arrow R6 direction, the fusing roller 110 returns to the position of FIG. 25 because it is pressed by the pressure spring 130 in arrow A4 direction. Namely, during the rotation of the slide cam 129 in arrow R6 direction, the fusing roller 110 is to be reciprocated in the axial direction. During the rotation of the fusing roller 110, the fusing roller 110 is reciprocated by the slide cam 129 rotating in arrow R6 direction.

Figure 27:
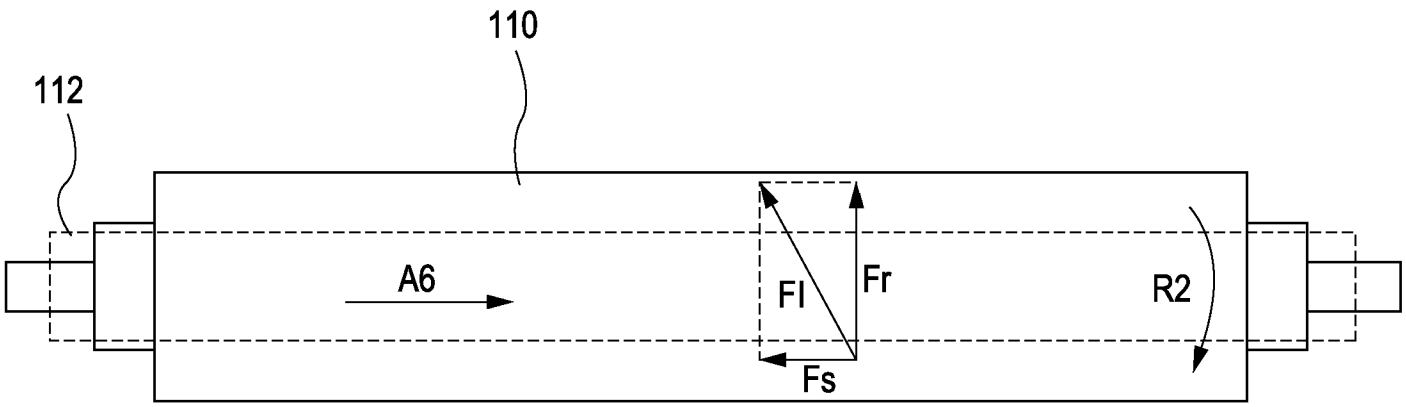
FIG. 27 is a plan view of the fusing unit according to the sixth embodiment.

Referring to FIG. 27, the frictional force will be described that is produced by the siding of the fusing roller 110 over the heating member 112 during the reciprocating of the fusing roller 110. Since the fusing roller 110 is rotating, a frictional force Fr is applied to the fusing roller at the contact heating head N1 to the sliding member 112 in a direction opposite to the rotational direction. Furthermore, since the fusing roller is reciprocated in the axial direction, a frictional force is applied to the fusing roller in a direction reverse to its moving direction. FIG. 27 shows the frictional force Fs applied during the moving in the A6 direction of the fusing roller 110. A resultant force F1 of these two forces is applied to the surface of the fusing roller. Since the fusing roller 110 is reciprocated, the force F1 has a component in a direction different from the rotational direction, and the force is periodically varied with time.

In a conventional configuration, if a foreign material, such as dust, is pinched into the contact heating head N1, the foreign material is liable to be retained in the contact heating head N1. Thus, the retained foreign material scrapes away the same position on the surface of the fusing roller, so that this may lead to generate a deep scratch in the rotational direction of the fusing roller.

Whereas, according to the embodiment, the frictional force received by the foreign material at the contact heating head N1 has a component directed differently from the rotational direction of the fusing roller as mentioned above, so that if the foreign material might be pinched into the contact heating head N1, it may sneak away the contact heating head N1. Thus, the foreign material may not scrape away the same position on the surface of the fusing roller, thereby suppressing the deep scratch on the surface of the fusing roller.

The releasing layer 118 that is the surface layer of the fusing roller 110 is extended to be scaly due to the above-mentioned frictional force F1 and the heat from the halogen heater. Namely, during the rotating of the rotational body while being heated by the halogen heater (heating unit), by moving the rotational body in an intersecting direction, the releasing layer is extended in the intersecting direction.

As mentioned above, by covering scratches on the surface of the fusing roller 110 with the releasing layer extended over the whole surface of the fusing roller 110 to be scaly, the streak becomes difficult to emerge on fixed images. Even when the releasing layer 118 extended to be scaly cannot cover the entire scratches generated on the surface of the fusing roller 110 such that the scratch becomes difficult to appear, the scratch on fixed images can be effectively prevented from emerging thereon as long as the releasing layer can partially cover the scratches.

As described above, the frictional force and the temperature applied to the surface of the fusing roller 110 are required for having an effect extending the releasing layer 118 to be scaly.

First, the frictional force applied to the surface of the fusing roller 110 includes the frictional force F1 generated due to the sliding between the fusing roller 110 and the sliding member 112 as described above in the embodiment. For obtaining the frictional force F1, the peak value of the normal pressure at the contact heating head N1 is set at $1.2\times10^5$ N/m$^2$ according to the embodiment. For obtaining the frictional force F1 efficiently extending the releasing layer 118 to have the scaly face, it is desirable that the peak value of the normal pressure at the contact heating head N1 be at least $9.8\times10^4$ N/m$^2$.

Then, the temperature for effectively extending the releasing layer 118 to have the scaly face requires a temperature at the glass transition point (Tg) or more of the releasing layer 118. The temperature at the glass transition point of PFA used for the releasing layer according to the embodiment is about 118° C. The releasing layer 118 can be efficiently extended to have the scaly face by setting the surface temperature of the fusing roller at 180° C., which is the same as the target temperature during fusing toner images on the recording member.

In a conventional configuration in that the surface of the releasing layer is fractionized by sliding to have scratches, even when the fusing roller 110 is fixed, and it is slid over the sliding member 112 only in the rotational direction, by satisfying the conditions of the frictional force and the temperature mentioned above, the releasing layer 118 is partially extended to have the scaly face; however, the benefits of repairing scratches like in the embodiment cannot be obtained, and its reasons will be described below.

As described above, in the conventional configuration the frictional force Fr applied to the surface of the fusing roller 110 is directed only in the rotational direction. In this case, the releasing layer 118 is extended in the rotational direction to have the scaly face, so that the extended portion scarcely covers scratches deeply produced in the rotational direction. Thus, the scratches cannot be repaired.

On the other hand, according to the embodiment, the fusing roller 110 is reciprocated in the axial direction as described above, so that the frictional force applied to the surface of the fusing roller 110 has a component directed in a direction different from the rotational direction. Accordingly, since the releasing layer 118 is extended to have a scaly face in random directions other than the rotational direction (to be a sore state), the scaly portion covers the deep scratch generated in the rotational direction, enabling the scratch to be repaired. The repairing principle has been described in detail in the second embodiment, so that it is omitted.

When the releasing layer on the surface of the fusing roller 110 is transformed to be scaly in such a manner, even if a foreign material is retained at the contact heating head N1 to rub the surface of the fusing roller, the scratch breaks off intermittently with the unevenness of the scaly releasing layer so as to also have a benefit in that the scratch is difficult to be transferred onto fixed images on the recording member as a vertical streak. Namely, the unevenness of the scaly releasing layer affects not only the vertical streak but also various scratches due to the attack from paper processing and contaminant, such as dust and shifted toner, to have scratch suppressing benefits.

If the slide displacement W1 of the fusing roller 110 due to the slide cam 129 is about 1 mm, the above-mentioned benefits can be obtained; as this effect is significant when the slide displacement W1 is rather larger, and according to the embodiment, the slide displacement W1 is set at 4 mm. If the reciprocating period of the fusing roller 110 is synchronized with the rotating period of the fusing roller 110, the same position on the surface of the fusing roller 110 is slidably rubbed at the contact heating head N1, so that the scratch is liable to be generated on the fusing roller 110, significantly reducing the scratch suppressing and repairing benefits.

At least, the reciprocating period of the fusing roller 110 must not be synchronized with the rotating period of the fusing roller 110. According to the embodiment, the period of the fusing roller 110 is about 1.00 sec while the sliding time per reciprocation of the fusing roller 110 is set at 2.45 sec.

In a conventional configuration, the generated and not repaired scratch of the fusing roller is transferred onto toner images on the recording member during fusing. In low print coverage rate images, such as a document and half tone images, the scratch of the fusing roller is difficult to appear; whereas, in high print coverage rate images, such as solid images and a photograph, the scratch of the fusing roller is liable to appear as glossiness unevenness and a vertical streak on the toner images. The scratch on the toner images may be conspicuous especially when using glossy paper requiring glossiness, because for increasing the image glossiness, it is necessary that toner is sufficiently fused so as to sufficiently transfer the surface configuration of the fusing roller onto the surface of the toner images. When the surface roughness (Rz) is about 6 μm or more, not only on the glossy paper, but also on normal paper not requiring glossiness, the vertical streak may emerge dependently on the print coverage rate. Hence, it is necessary that the surface roughness Rz is to be 3 μm or less for rendering the scratch transferred on toner images on the recording member inconspicuous. When the roughness average Rz is 3 μm or less, the glossiness unevenness and the vertical streak are inconspicuous on even images with high print coverage rate fixed on glossy paper.

Figure 28:
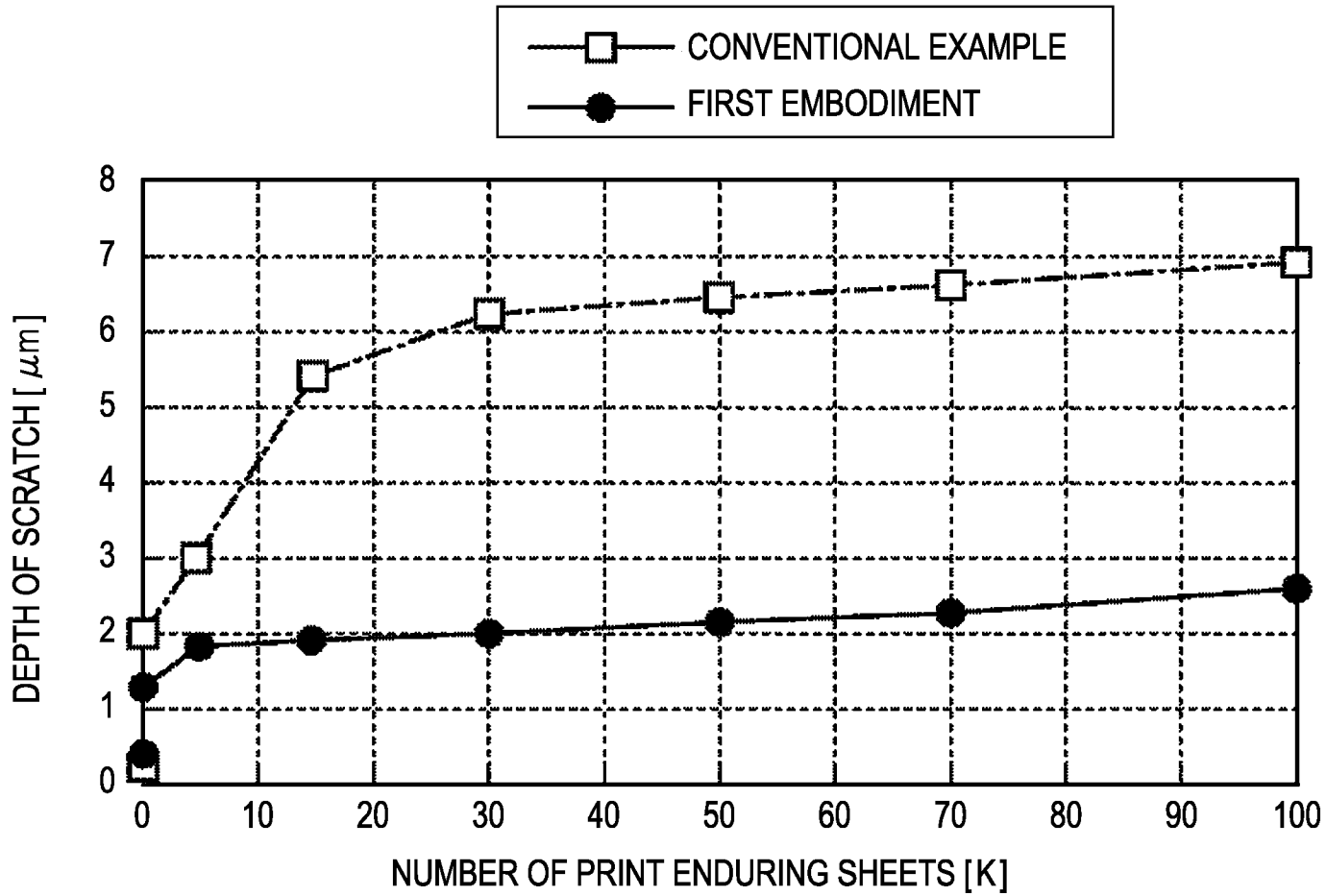
FIG. 28 is a drawing showing results from the print endurance tests in the sixth embodiment.

In the configuration described above, the print endurance was tested and compared with the conventional configuration. In the print endurance test, images with 5% print coverage rate were continuously printed; up to continuous 10,000 sheets, the scratch on the fusing roller was checked every 1,000 sheets; and after continuous 10,000 sheets, the scratch was checked every 10,000 sheets. The scratch on the fusing roller was confirmed by measuring the scratch depth with a surface roughness gauge and by checking the presence of the vertical streak on the solid images on normal paper and glossy paper. FIG. 28 shows the results of the scratch depth of the fusing roller from the print endurance test. Numeral 10 on a scale in abscissa denotes 10,000 sheets.

In the conventional configuration, at first 4,000-sheet printing, the scratch depth (10-point roughness average Rz) of the fusing roller reaches 3 μm or more and the vertical streak is generated on solid images on the glossy paper. Furthermore, after 30,000 sheets, the scratch depth (10-point roughness average Rz) of the fusing roller becomes 6 μm or more and the vertical streak is generated on solid images even on the normal paper.

Whereas, in the configuration according to the embodiment, since the fusing roller 110 is slid in a state arranged in contact with the sliding member 112, the scratch depth (10-point roughness average Rz) of the fusing roller can be reduced below 3 μm up to 100,000-sheet printings, which are the life-time printings of the fusing unit according to the embodiment. Thus, when images are formed even on the glossy paper, on which the vertical streak is liable to be conspicuous, image streak failure has not generated on the solid images until the end of the fusing unit life.

Even when scaly irregularities are formed on the surface layer of the fusing roller with the configuration according to the embodiment, the adverse effect due to the scaly portion, such as reduced glossiness of the fixed images, is difficult to occur. The reason is that the releasing layer is sufficiently extended due to the heat and the frictional force during the transforming to have the scaly face, so that the scaly portion does not become sharp steps that reduce the glossiness of the fixed images. Like in a conventional configuration in that the surface properties are maintained constant (refreshed) to have fine scratches using a sliding member, although the evenness of the surface of the fusing member, i.e., the surface of the releasing layer can be obtained, the glossiness of the surface is reduced. Whereas, according to the embodiments, the surface of the fusing member, i.e., the surface of the releasing layer 118 is excellent in glossiness as well as in evenness of the surface roughness.

Figure 31:
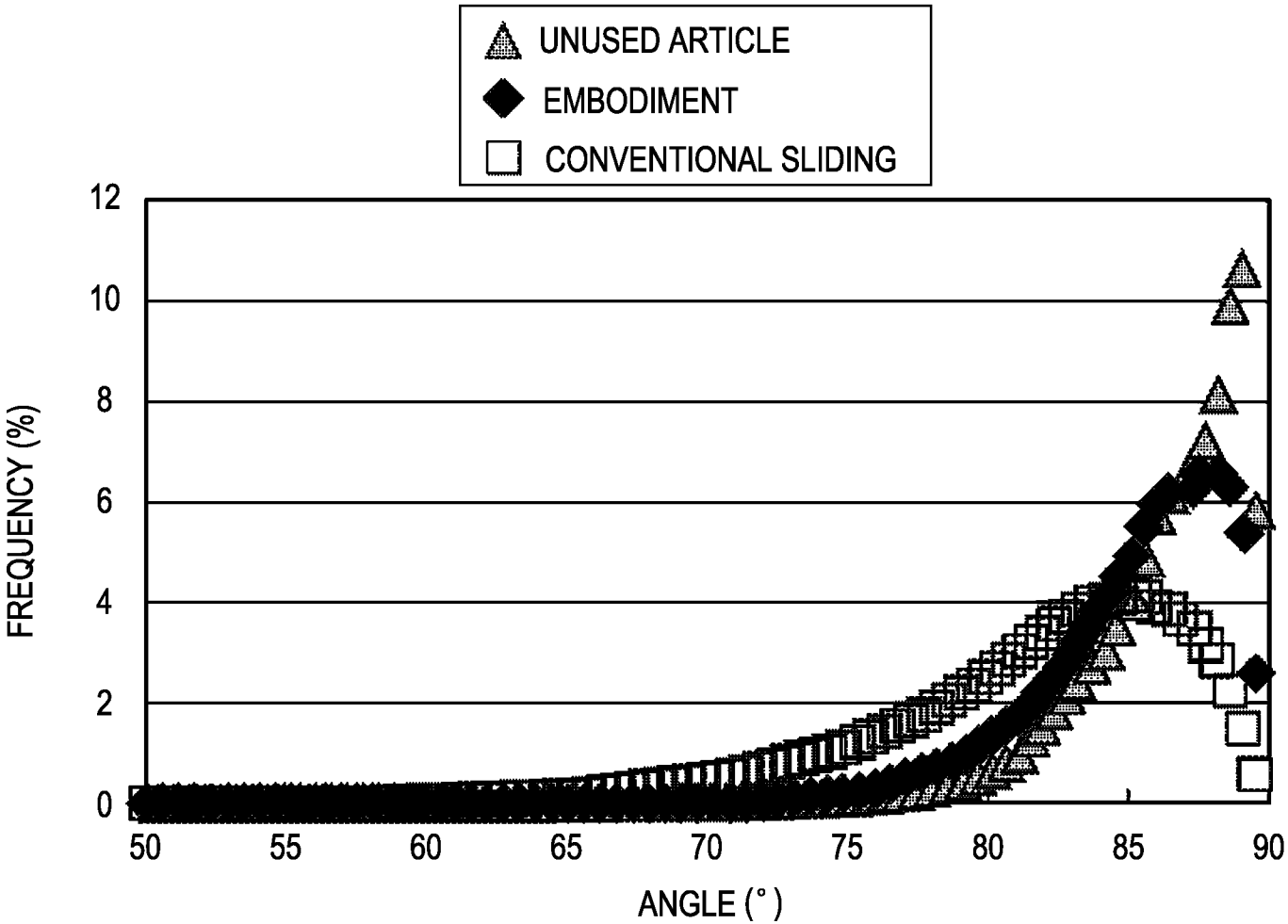
FIG. 31 is a surface angle histogram showing the surface nature of the fusing roller with frequency distributions of the surface angle.

FIG. 31 shows a surface angle histogram (measured with Micromap System made from Ryoka Systems Inc.). The drawing shows the surface nature with the frequency distributions of the surface angle, in which the angle 90° denotes the smooth surface, and with increasing inclination, the angle value is reduced. Within the range close to the smooth surface (90°), with increasing frequency distribution, the smoothness is increased. On images, part with the surface angle 85° or more significantly contributes to the glossiness. As compared to the frequency distribution of unused articles, in the frequency distribution in the conventional sliding method (the method for maintaining the surface property with fine scratches), it is understood that the frequency distribution with the surface angle 85° or more is significantly reduced while the frequency distribution with the surface angle 85° or less is largely increased. Whereas, according to the embodiment, although the frequency distribution of the smooth surface (in the vicinity of 90°) is reduced, it is understood that the increase in frequency distribution below 85° is small while the decrease in frequency distribution with the surface angle 85° or more is significantly remained in comparison with the conventional configuration. Hence, according to the embodiment, while maintaining high glossiness of images, the evenness in surface property can be obviously obtained.

In a conventional configuration, when a number of small-sized sheets are processed, scratches may be generated due to sheet edges in the rotational direction of the fusing roller 110; whereas, according to the embodiment, since the benefit of repairing scratches by extending the releasing layer 118 is obtained, even when a number of small-sized sheets are processed, severe scratches causing image failure may not be generated on the fusing roller.

Figure 29:
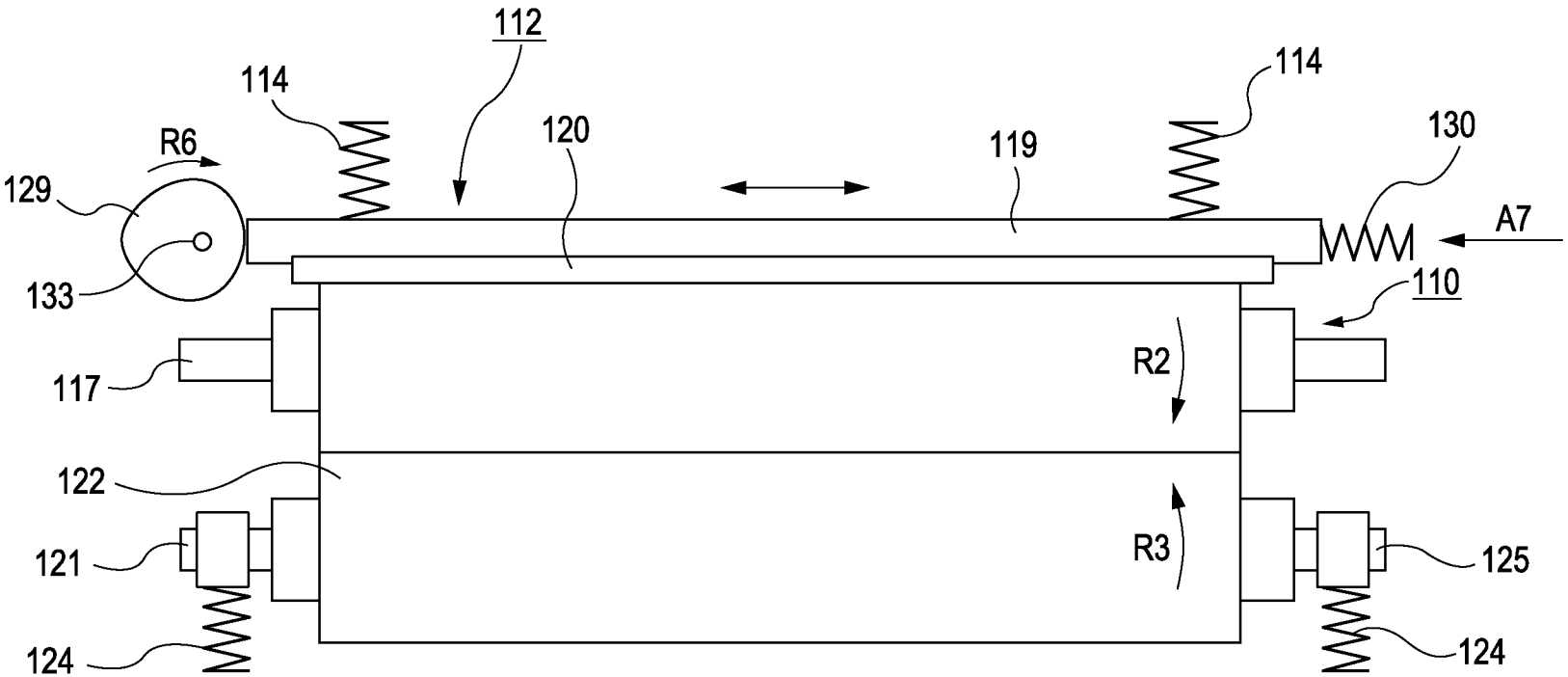
FIG. 29 is a schematic sectional view of a fusing unit according to a modification from the sixth embodiment, in which the sliding member 112 is moved.

In the configuration according to the embodiment described above, the sliding member 112 is fixed and the fusing roller 110 is reciprocated; alternatively, the fusing roller 110 may be fixed and the sliding member 112 may be reciprocated; or both the sliding member 112 and the fusing roller 110 may be reciprocated. For example, FIG. 29 shows an example configuration in that only the sliding member 112 is reciprocated. The slide cam 129 and the slide pressure spring 130 are arranged on both ends of the sliding member 112, respectively, and the mechanism for reciprocating the fusing roller 110 is applied to the sliding member 112 as it is. Also in this configuration, by the reciprocating the sliding member 112, the frictional force applied to the surface layer of the fusing roller 110 at the contact heating head N1 has a component directed in a direction other than the rotational direction, so that the releasing layer 118 can be extended in random directions so as to cover and repair scratches on the fusing roller. By the same reason as described above, the scratch can be prevented from being generated. Namely, during the rotation of the rotational body while being heated by the halogen heater (the heating unit), at least one of the rotational body and the sliding member is moved in an intersecting direction so that the releasing layer is to be extended in the intersecting direction.

Figure 30:
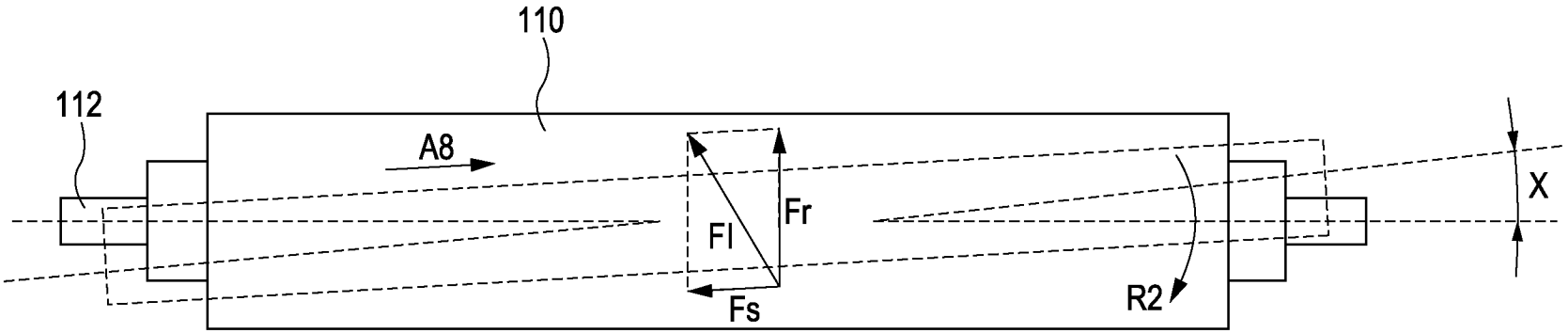
FIG. 30 is a drawing illustrating an example where the axial direction of the sliding member is arranged in non-parallel with that of the fusing roller.

The reciprocating direction of the sliding member 112 and the fusing roller 110 is not limited to the axial direction. For example, the axis of the sliding member 112 may be shifted to that of the fusing roller 110. FIG. 30 is a plan view of the configuration in that the sliding member 112 is shifted to the rotational axis of the fusing roller 110 changed from the configuration in that the sliding member 112 is reciprocated in the rotational axial direction of the fusing roller 110. As described above, the frictional force Fr is produced due to the rotation of the fusing roller 110 and the frictional force Fs is produced due to the reciprocation of the sliding member 112 (in the drawing, the sliding member 112 moving in the A8 direction is shown). Since the resultant force F1 of the frictional forces Fs and Fr has a component in a direction different from the rotational direction, the scratch can be prevented from being generated and if it is generated, the scratch can be repaired.

As the shifting angle X of the rotational axis of the fusing roller 110 from the axis Z1 of the sliding member 112 in the longitudinal direction becomes excessively large, adverse effects are produced in that the member width must be increased for uniformly abutting the contact heating head. Therefore, according to the embodiment, X=5°.

According to the embodiment, a PTFE fluororesin sheet is used in the sliding layer 120; alternatively, a metallic sheet, such as aluminum (AL) and SUS, may also be used for efficiently transferring the heater heat to the fusing roller 110.

As described above, when the fusing roller 110 and the sliding member 112 have a sliding component directed in a direction different from the rotational direction of the fusing roller 110, the frictional force is applied to the releasing layer 118 on the fusing roller 110 in a direction different from the rotational direction, so that the scaly releasing layer is formed over the entire circumference of the fusing roller 110 in the rotational direction, so that the benefit repairing scratches can be obtained. Also, since a foreign material in the fusing nip is liable to come off, scratches can be prevented from being generated.

According to the embodiment, the rotatable fusing roller 110 is used for the fusing member; alternatively, a fusing belt may be used for the fusing member. As long as the fusing member has the releasing layer like described above, the benefits of the embodiments are not impaired.

Seventh Embodiment

A seventh embodiment of the present invention will be described below. Like reference numerals and symbols designate like components common to the first to sixth embodiments and the description is omitted.

The releasing layer 118 of the fusing roller (the image heating rotational body) 110 described in the first to sixth embodiments is not scaly as shown in FIG. 5A in an initial stage (a new image forming apparatus) assembled in the fusing unit but the releasing layer 118 has a uniform surface as conventionally used. Then, using the units described in the first to sixth embodiments, by driving the fusing unit for several minutes, the releasing layer 118 of the fusing roller 110 is extended to be scaly.

In the configuration according to the first to sixth embodiments, even a period of several minutes is required for transforming the releasing layer 118 to be scaly, the benefit of suppressing scratches can be obtained as described above, so that severe scratches resulting in image failure, such as a vertical streak, cannot be generated on the fusing roller 110.

However, for obtaining further benefits for suppressing and repairing scratches, it is desirable that the releasing layer 118, which has been extended to be scaly in advance, of the fusing roller 110 be assembled in the fusing unit.

Namely, in the manufacturing stage of the fusing roller 110, as shown in FIG. 11B, the releasing layer 118 is to be extended and transformed to be scaly by the method described in the first to sixth embodiments.

When the releasing layer 118 is transformed into a scaly face from the initial stage, as described in the first to sixth embodiments, in the unlikely event that a foreign material comes into the contact heating head N1 so as to grind the surface layer of the fusing roller 110, scratches may be generated only intermittently, not resulting in deep scratches due to scaly unevenness. Even if a scratch is generated, since the releasing layer 118 has been transformed to be scaly, the scratch can be promptly covered with the scaly releasing layer 118 so as to repair the scratch by the method described in the first to sixth embodiments.

In such a manner, when the releasing layer of the image heating rotational body includes the scaly releasing layer extended in an intersecting direction with the rotational direction of the rotational body, the period of time required for repairing scratches can be reduced.

Other Embodiments

According to the sixth and seventh embodiments described above, a hold-down member like the sliding member 112 is used; the invention is not limited to this. For example, a rotatable sliding member may also be used as long as the rotatable sliding member does not completely follow the fusing roller 110. In the configuration of sliding over the surface of the fusing roller 110 when the temperature on the contact surface maintains the glass transition point of the releasing layer or more relative to the surface of the fusing roller 110 regardless of the forward direction or the counter direction, as long as the frictional force and the temperature are applied on the surface of the fusing roller 110 in not only the circumferential direction but also in the longitudinal direction, the advantages of the embodiments are not impaired. Namely, it is obvious that the rotatable sliding member may be fixed or may have a peripheral speed difference relative to the fusing roller 110.

According to the embodiments, the sliding member 112 are provided over the entire surface in the longitudinal direction; alternatively, the sliding member 112 may be provided in only a part where scratches are liable to be generated in the longitudinal direction to have the same advantages of the embodiments.

The suppressing and repairing scratches on the fusing roller are described; alternatively, when a fusing system using a fusing belt or fusing film other than those described above as a fusing member arranged in contact with toner images is incorporated in the invention, the same scratch suppressing and repairing benefits as in the sixth embodiment are obtained for the surface of the fusing member. Also, the pressure roller is used for a pressure member for forming the fusing nip N2; alternatively, a not-rotatable pad member other than a roller may also be used.

In the above-described embodiments, the fusing unit to be mounted on the image forming apparatus is exemplified; the present invention is not limited to the fusing unit to be mounted on the image forming apparatus. For example, a glossiness applicator available as an optional unit for again heating the images, which have been fixed by the fusing unit, for improving image glossiness can also be applied to the technical spirit of the invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2007-292191 filed Nov. 9, 2007 and No. 2007-330948 filed Dec. 21, 2007, which are hereby incorporated by reference herein in their entirety.

What is claimed is:

1. An image heating apparatus for heating an image formed on a recording member, comprising:

a rotational body arranged in contact with the recording member carrying an image thereon, the rotational body including a resin layer being formed on a surface;

a heating member arranged in contact with the resin layer of the rotational body and configured to heat the rotational body, the heating member including a sliding layer that contacts the resin layer of the rotational body; and a backup member forming a nip, in cooperation with the rotational body, that pinches and conveys the recording member carrying the image thereon, wherein the sliding layer of the heating member can be moved only in an intersecting direction with a rotational direction of the rotational body in a state that the resin layer of the rotational body and the sliding layer of the heating member are arranged in contact with each other so that the resin layer is extended in the intersecting direction with a rotational direction of the rotational body.

2. The apparatus according to claim 1, further comprising a movement mechanism configured to move the sliding layer of the heating member in the intersecting direction.

3. The apparatus according to claim 1, wherein the sliding layer of the heating member is moved in the intersecting direction during heating the recording member carrying the image thereon.

4. An image heating apparatus for heating an image formed on a recording member, comprising:

a rotational body including a resin layer on its surface;

a heating unit configured to heat the rotational body;

a backup member forming a nip, in cooperation with the rotational body, that pinches and conveys the recording member carrying the image thereon; and a sliding member arranged in contact with the surface of the rotational body, wherein the sliding member can be moved only in an intersecting direction with a rotational direction of the rotational body in a state that the rotational body and the sliding member are arranged in contact with each other so that the resin layer is extended in the intersecting direction with a rotational direction of the rotational body.

5. The apparatus according to claim 4, wherein during the rotation of the rotational body while the heating unit heating the rotational body, the sliding member is moved in the intersecting direction so as to extend the resin layer in the intersecting direction.

6. An image heating apparatus for heating an image formed on a recording member, comprising:

a rotational body arranged in contact with the recording member carrying an image thereon, the rotational body including a resin layer being formed on a surface;

a heating member arranged in contact with the resin layer of the rotational body and configured to heat the rotational body; and a backup member forming a nip, in cooperation with the rotational body, that pinches and conveys the recording member carrying the image thereon, wherein the rotational body can be moved in an intersecting direction with a rotational direction of the rotational body in a state that the resin layer of the rotational body and the heating member are arranged in contact with each other so that the resin layer is extended in the intersecting direction.

7. The apparatus according to claim 6, further comprising a movement mechanism configured to move the rotational body in the intersecting direction.

8. The apparatus according to claim 6, wherein the rotational body is moved in the intersecting direction when the rotational body is heated by the heating member and the rotational body is rotated.

9. An image heating apparatus for heating an image formed on a recording member, comprising:

a rotational body including a resin layer on its surface;

a heating unit configured to heat the rotational body;

a backup member forming a nip, in cooperation with the rotational body, that pinches and conveys the recording member carrying the image thereon; and a sliding member arranged in contact with the surface of the rotational body, wherein the rotational body can be moved in an intersecting direction with a rotational direction of the rotational body in a state that the rotational body and the sliding member are arranged in contact with each other so that the resin layer is extended in the intersecting direction.

10. The apparatus according to claim 9, further comprising a movement mechanism configured to move the rotational body in the intersecting direction.

11. The apparatus according to claim 9, wherein the rotational body is moved in the intersecting direction when the rotational body is heated by the heating unit and the rotational body is rotated.

12. An image heating apparatus for heating an image formed on a recording member, comprising:

a rotational body arranged in contact with the recording member carrying an image thereon, the rotational body including a resin layer being formed on a surface;

a heating member arranged in contact with the resin layer of the rotational body and configured to heat the rotational body, the heating member including a sliding layer that contacts the resin layer of the rotational body; and a backup member forming a nip, in cooperation with the rotational body, that pinches and conveys the recording member carrying the image thereon, wherein the sliding layer of the heating member can be moved only in an intersecting direction with a rotational direction of the rotational body in a state that the resin layer of the rotational body and the sliding layer of heating member are arranged in contact with each other so that the resin layer is transformed to a scaly face extended in the intersecting direction.

13. The apparatus according to claim 12, further comprising a movement mechanism configured to move the sliding layer of the heating member in the intersecting direction.

14. The apparatus according to claim 12, wherein the sliding layer of the heating member is moved in the intersecting direction when the rotational body is heated by the heating member and the rotational body is rotated.

15. An image heating apparatus for heating an image formed on a recording member, comprising:

a rotational body including a resin layer on its surface;

a heating unit configured to heat the rotational body;

a backup member forming a nip, in cooperation with the rotational body, that pinches and conveys the recording member carrying the image thereon; and a sliding member arranged in contact with the surface of the rotational body, wherein the sliding member can be moved only in an intersecting direction with a rotational direction of the rotational body in a state that the rotational body and the sliding member are arranged in contact with each other so that the resin layer is transformed to a scaly face extended in the intersecting direction.

16. The apparatus according to claim 15, further comprising a movement mechanism configured to move the sliding member in the intersecting direction.

17. The apparatus according to claim 15, wherein the sliding member is moved in the intersecting direction when the rotational body is heated by the heating unit and the rotational body is rotated.

18. An image heating apparatus for heating an image formed on a recording member, comprising:

a rotational body arranged in contact with the recording member carrying an image thereon, the rotational body including a resin layer being formed on a surface;

a heating member arranged in contact with the resin layer of the rotational body and configured to heat the rotational body; and a backup member forming a nip, in cooperation with the rotational body, that pinches and conveys the recording member carrying the image thereon, wherein the rotational body can be moved in an intersecting direction with a rotational direction of the rotational body in a state that the resin layer of the rotational body and the heating member are arranged in contact with each other so that the resin layer is transformed to a scaly face extended in the intersecting direction.

19. The apparatus according to claim 18, further comprising a movement mechanism configured to move the rotational body in the intersecting direction.

20. The apparatus according to claim 18, wherein the rotational body is moved in the intersecting direction when the rotational body is heated by the heating member and the rotational body is rotated.

21. An image heating apparatus for heating an image formed on a recording member, comprising:

a rotational body including a resin layer on its surface;

a heating unit configured to heat the rotational body;

a backup member forming a nip, in cooperation with the rotational body, that pinches and conveys the recording member carrying the image thereon; and a sliding member arranged in contact with the surface of the rotational body, wherein the rotational body can be moved in an intersecting direction with a rotational direction of the rotational body in a state that the rotational body and the sliding member are arranged in contact with each other so that the resin layer is transformed to a scaly face extended in the intersecting direction.

22. The apparatus according to claim 21, further comprising a movement mechanism configured to move the rotational body in the intersecting direction.

23. The apparatus according to claim 21, wherein the rotational body is moved in the intersecting direction when the rotational body is heated by the heating unit and the rotational body is rotated.

* * * * *